US007292794B2

(12) United States Patent
Yoshizawa

(10) Patent No.: US 7,292,794 B2
(45) Date of Patent: Nov. 6, 2007

(54) SYSTEM, APPARATUS, AND METHOD FOR PREVENTING ACCESS TO INFORMATION STORED IN A CONSUMABLE ITEM OF AN IMAGE FORMING APPARATUS

(75) Inventor: Hiroshi Yoshizawa, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 295 days.

(21) Appl. No.: 11/083,036

(22) Filed: Mar. 18, 2005

(65) Prior Publication Data

US 2005/0213997 A1 Sep. 29, 2005

(30) Foreign Application Priority Data

Mar. 18, 2004 (JP) ..... 2004-078181
Oct. 21, 2004 (JP) ..... 2004-306707

(51) Int. Cl.
*G03G 15/00* (2006.01)

(52) U.S. Cl. ..... 399/24; 399/25; 399/26; 399/27

(58) Field of Classification Search ..... 399/8, 399/9, 12, 24, 25, 26, 27; 347/19
See application file for complete search history.

(56) References Cited

U.S. PATENT DOCUMENTS 6,768,877 B2 * 7/2004 Alegria et al. ..... 399/9
6,865,349 B2 * 3/2005 Silence et al. ..... 399/8
7,139,493 B2 * 11/2006 Ito et al. ..... 399/12
2006/0062583 A1 * 3/2006 Kikuchi ..... 399/24
2007/0047974 A1 * 3/2007 Tanaka ..... 399/8

FOREIGN PATENT DOCUMENTS

| | | |
|---|---|---|
| JP | 2001-272890 | 10/2001 |
| JP | 2003-076230 | 3/2003 |
| JP | 2003-131544 | 5/2003 |
| JP | 2003-140456 | 5/2003 |

OTHER PUBLICATIONS

U.S. Appl. No. 10/926,224, filed Aug. 26, 2004, Kikuchi.
U.S. Appl. No. 10/975,621, filed Oct. 29, 2004, Kikuchi.

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus having a recognizing member configured to read a property stored in a memory member of a consumable item via a communication member, and to recognize if the consumable item can be used. The image forming apparatus also includes a property changing member configured to communicate to the memory member and to change a parameter so that information stored in the memory member cannot be accessed when the recognizing member recognizes the consumable item can be no longer used.

36 Claims, 16 Drawing Sheets

SYSTEM, APPARATUS, AND METHOD FOR PREVENTING ACCESS TO INFORMATION STORED IN A CONSUMABLE ITEM OF AN IMAGE FORMING APPARATUS

BACKGROUND OF THE INVENTION

1. Field of the Invention

The present invention relates to an image forming apparatus and a consumable item, and more specifically to the consumable item as used in the image forming apparatus for forming images in a copying apparatus, a facsimile apparatus, a printer or the like, and to the image forming apparatus which uses the consumable item.

2. Discussion of the Related Art

An image forming apparatus of the type using electrostatic image transfer system, ink jet image forming system, or the other image forming system, uses a consumable item that is consumed by forming images. The consumable item is, for example, a photoconductive member, a charging device, a developing device, a toner used in the developing device, a transferring device, a fixing device, and the like. The consumable item may be formed as a unit that includes one consumable item, or collectively includes a plurality of consumable items. For example, a consumable item may be a toner used in a developing device is formed a toner bottle as a unit that is manufactured or sold. Also, a process cartridge is a consumable item that is well known. The process cartridge is a unit that collectively includes a photoconductive member, a charging device, and a developing device.

A consumable item like a process cartridge or a toner bottle sometimes has a memory member storing predetermined information. Both Japanese laid-open patent publication no. 2003-076230 and Japanese laid-open patent publication no. 2001-272890 show a consumable cartridge having a memory area which can store an ID code. Both of Japanese laid-open patent application nos. 2003-076230 and 2001-272890 further describe image forming apparatuses that check the ID stored in a memory area of the cartridge. The image forming apparatuses permit the forming an image only if the ID code can be confirmed.

that In Japanese laid-open patent application nos. 2003-076230 and 2001-272890, when the cartridge reaches an end of life or when the consumable item is depleted, the ID code is deleted to prevent unauthorized refurbishment, repair, refilling and/or reuse.

However, in both of Japanese laid-open patent application nos. 2003-076230 and 2001-272890, if the cartridge is abandoned after the cartridge reaches an end of life, or after the consumable item is used up, information stored in the memory area may be exposed to third party. Examples of information that may be exposed includes seller information, manufacturer information, and user information.

Also, Japanese laid-open patent publication no. 2003-131544 shows a cartridge having a memory with separate areas. One of these areas stores information regarding a seller. Such information originally stored in the area is saved on an image forming device or its host computer, when the cartridge mounts on the image forming device or when an accident occurs. However, like the previously identified references, if a cartridge built according to Japanese laid-open patent publication no. 2003-131544 is abandoned after the cartridge reaches an end of life, or after the consumable item is used up, information stored in the memory area may be exposed to third party.

Thus, as discovered by the present inventors, it is desirable to have an image forming device and corresponding consumable item that can protect information stored in a memory area of the consumable item.

SUMMARY OF THE INVENTION

To address the above described and other problems, it is an object of the present invention to provide an image forming apparatus and corresponding consumable item that can protect information that may be stored in a memory area of the consumable item. (Modified for your review)

Thus, one embodiment of the present invention includes an image forming apparatus that includes a recognizing member configured to read a property stored in a memory member of a consumable item via a communication member, and to recognize if the consumable item can be used. The image forming device also includes a property changing member configured to communicate to the memory member via the communication member and to change to the information stored in the memory member cannot be obtained, in the case that the recognizing member recognizes if the consumable item can be no longer used.

The present invention further provides a consumable item for an image forming apparatus. The consumable item includes a recognizing member configured to read a property stored in a memory member of the consumable item and to recognize if the consumable item can be used. The consumable item may include a property changing member configured to communicate to the memory member and to ensure information stored in the memory member cannot be obtained, in the case that said first recognizing member recognizes if the consumable item can be no longer used.

The present invention is directed to other embodiments of image forming apparatuses and consumable items that are configured to protect information stored in a memory area of the consumable item.

BRIEF DESCRIPTION OF THE DRAWINGS

The accompanying drawings, which are incorporated in and constitute a part of the specification, illustrate the invention, and, together with the description, serve to explain the principles of the invention.

DESCRIPTION OF THE PREFERRED EMBODIMENTS

A preferred embodiment using the present invention is explained as below, referring to FIG. 1 to FIG. 12. The embodiment is related to an image forming apparatus having a detachably mounted process unit 108. The image forming apparatus can form a black or a color image such as a printer, a facsimile peripheral, a multi function peripheral, and a various image forming device.

Figure 1:
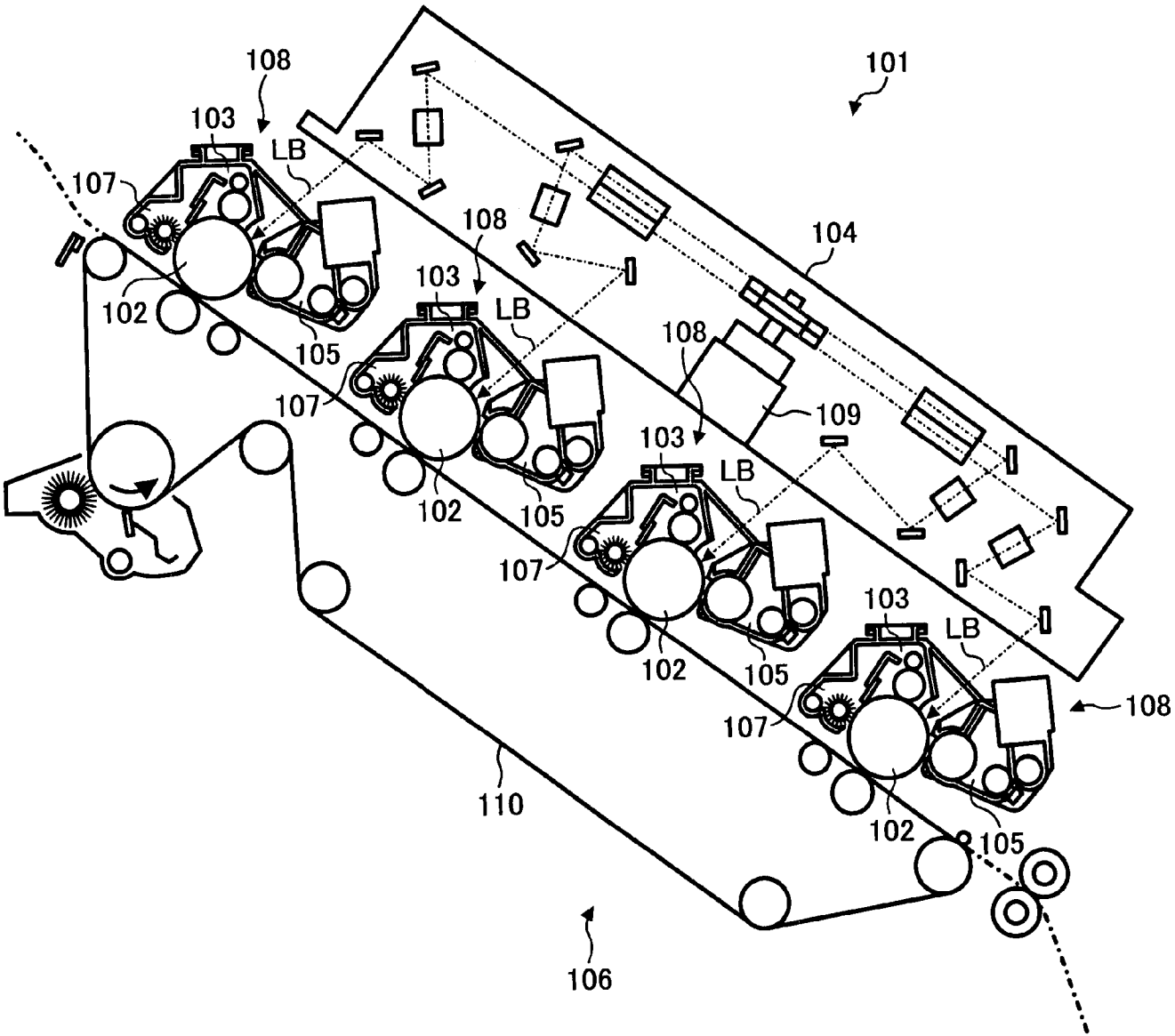
FIG. 1 is a partial sectional side drawing showing an image processing device of an image forming apparatus.

FIG. 1 is a partial sectional side drawing showing an image processing device 101 of an image forming apparatus. The image forming apparatus uses a tandem type image forming apparatus using four drums as shown FIG. 1. The image processing device 101 includes a plurality of process units 108, an exposing device 104 and a transferring device 106, and can form an image on a recording medium such as a paper, a sheet and the like. Process units 108 are an example of consumable items. (Modified for your review.)

Figure 2:
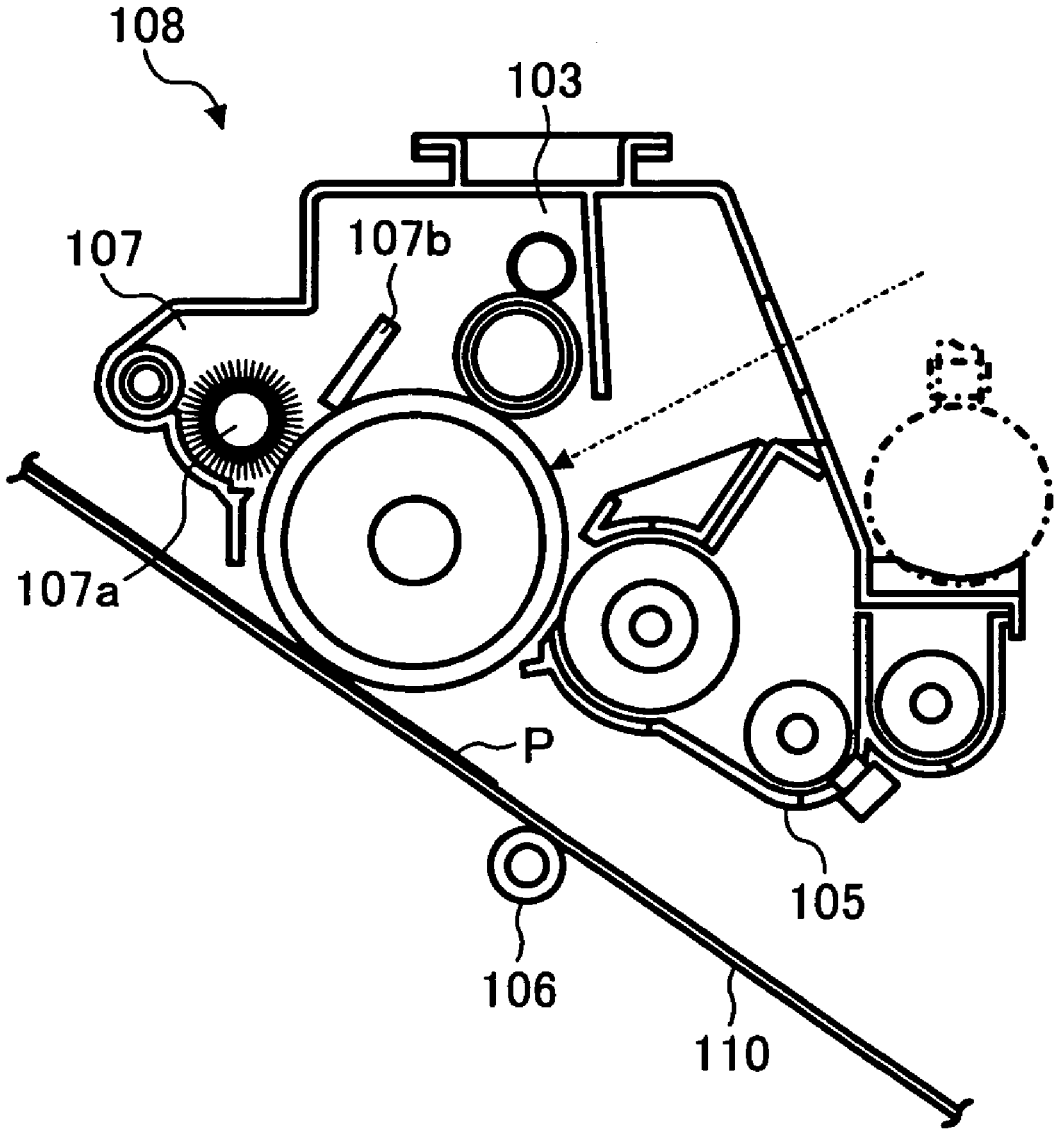
FIG. 2 is a sectional side drawing showing an example of a consumable item.

FIG. 2 is a partial sectional side drawing showing an example of a consumable item formed as a unit. In this embodiment, each process unit 108 includes a photoconductive member 102, and a charging device 103, a developing device 105 and a cleaning device 107, each of which are mounted around the photoconductive member 102. The image forming apparatus has four process units 108 as consumable items.

Further, the image forming apparatus includes an exposing device 104 as a unit that can generate laser beams separately to write each photoconductive member 102, using a single polygon mirror 109. Further, the image forming apparatus includes a transferring device 106 using a transferring belt 110 that can convey a recording medium. Process units 108 are mounted along a transferring direction, in a turn of M (Magenta), C (Cyan), Y (Yellow) and K (Black).

Next, an image forming process by the image processing device 101 stated above is explained. A charging device 103 uniformly charges a photoconductive member 102 to a preferable polarity. An exposing device 104 generates a laser beam corresponding to each color image signal on each photoconductive member 102, so that a latent image is formed on the photoconductive member 102. Consequently, a developing device 105 develops the latent image to a toner image. A transferring device 106 transfers the toner image on the photoconductive member 102 on a recording medium. A toner image on each photoconductive member 102 is overlapped on the recording medium in a turn of M (Magenta), C (Cyan), Y (Yellow) and K (Black), so that a color image is formed on the recording medium. After that, a fixing device (not shown) fixes the color image on the recording medium.

A cleaning device 107 includes a cleaning brush 107*a* and an electricity removing blade 107*b*. The cleaning brush 107*a* removes a residual toner on a photoconductive member 102 after transferred a toner image on a recording medium. The electricity removing blade 107*b* removes electricity on the photoconductive member 102 for next image forming.

In this embodiment, consumable process unit 108 includes a photoconductive member 102, a charging device 103, a developing device 105, and a cleaning device 107 that each has a predetermined lifetime. The image forming apparatus can detachably mount the consumable process unit 108 in a positioning member of the image forming apparatus.

Figure 3:
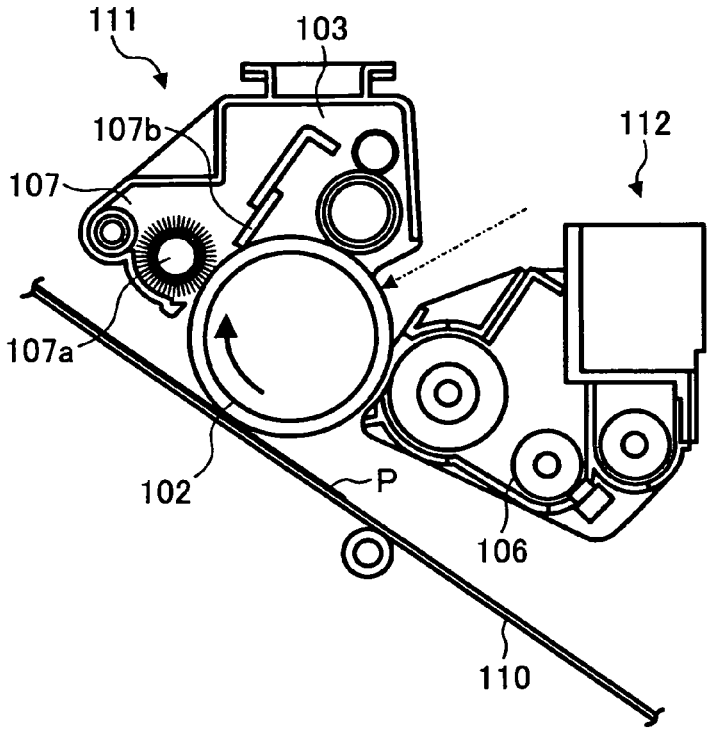
FIG. 3 is a partial sectional side drawing showing another example of a consumable item.

FIG. 3 is a partial sectional side drawing showing another example of consumable items. In the embodiment as shown FIG. 3, photoconductive unit 111 is a first consumable item. Photoconductive unit 111 includes a photoconductive member 102, a charging device 103 and a cleaning device 107 that each has a predetermined lifetime. Also, developing unit 112 is a consumable item. Developing unit 112 includes a developing device 105. The photoconductive unit 111 and the developing unit 112 are both detachably mounted in a portion of an image forming apparatus. As shown in the embodiment as shown in FIG. 3, a consumable item is not restricted to a single unit collectively including a plurality of consumable sub-items.

Figure 4:
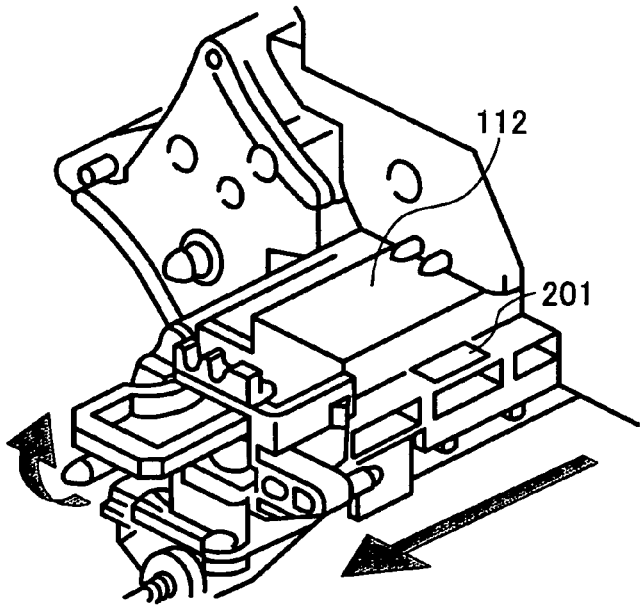
FIG. 4 is a partial perspective drawing showing an example of a replacement for a consumable item.

FIG. 4 is a partial perspective drawing showing an example of a replacement for a consumable item. As shown, an IC tag 201 as a memory medium is mounted on a consumable item like a process unit 108, a photoconductive unit 111 or a developing unit 112 as shown in FIG. 3. An IC tag 201 as a memory medium can be replaced to a non-volatile memory board, a contact-type print board having an IC chip, a non-contact type print board having an IC chip, a non-contact IC card and the like.

Figure 5:
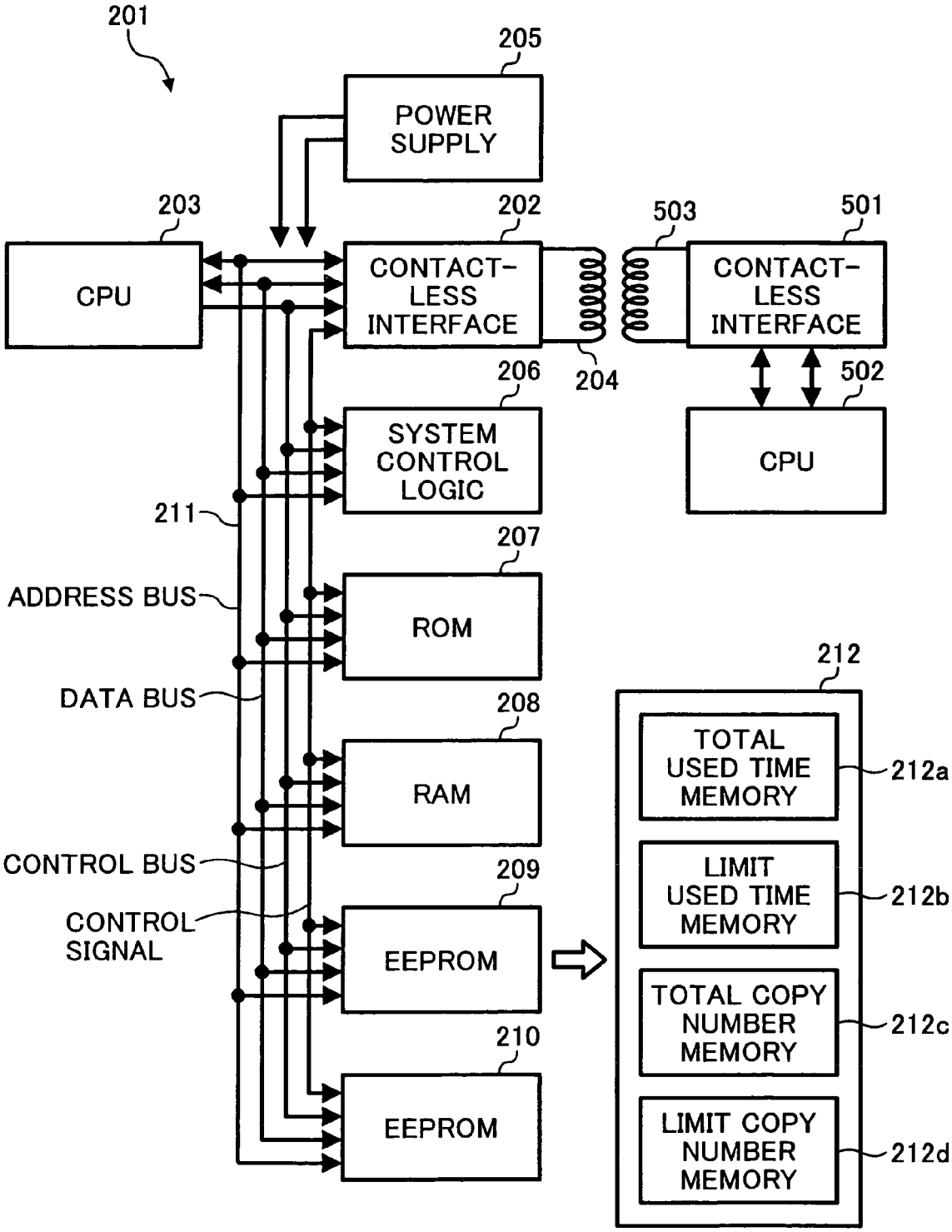
FIG. 5 is a block diagram showing an IC tag.

FIG. 5 is a block diagram showing an IC tag 201 mounted on a consumable item. In this embodiment, an IC tag 201 is a non-contact type that can communicate to a host image forming apparatus by wireless. In a part of the image forming apparatus, antenna 503 connects to contact-less interface circuit 501 connects to a CPU (central processing unit) 502 of an image forming apparatus via a serial (or parallel) interface. In a part of the IC tag 201, antenna 204 is connected to contact-less interface circuit 202 which connects a CPU 203 of an IC tag 201.

In a wireless communication from an image forming apparatus to an IC tag 201, a contact-less interface circuit 501 of an image forming apparatus can modulate a digital signal designated an output from a CPU 502 to an analog signal, and can output the analog signal on an electromagnetic wave from an antenna 503. A contact-less interface circuit 202 of an IC tag 201 can receive the analog signal transmitted by a contact-less interface circuit 501 of an image forming apparatus via an antenna 204, and can demodulate the received signal and can convert to a parallel signal. The contact-less interface circuit 202 is controlled by a CPU 203. In reverse, in a wireless communication from an IC tag 201 to an image forming apparatus, a contact-less interface circuit 202 of an IC tag 201 can modulate a digital signal designated an output from a CPU 203 to an analog signal, and can output the analog signal on an electromagnetic wave from an antenna 204. A contact-less interface circuit 501 of an image forming apparatus can receive the analog signal transmitted by a contact-less interface circuit 202 of an IC tag 201 via an antenna 503, and can demodulate the received signal and can convert to a parallel signal. The contact-less interface circuit 501 is controlled by a CPU 502.

A communication between an image forming apparatus and an IC tag 201 may be initiated by an analog signal that is transmitted from an image forming apparatus to an IC tag 201. At that time, an antenna 503 of an image forming apparatus transmits an electromagnetic wave to an antenna 204 of an IC tag 201. By such, a power supply 205 of the IC tag 201 can rectify the electromagnetic wave generated between two antennas 503 and 204, and can provide an electricity to various portions.

An IC tag 201 also includes system control logic 206, a ROM (read-only memory) 207, a RAM (random-access memory) 208, first and second EEPROMs (electrically erasable programmable read-only memory) 209 and 210 as a memory member. As same with the contact-less interface 202 stated above, these system control logic 206, the ROM 207, the RAM 208, the EEPROM 209, and the EEPROM 210 are connected to an CPU 203 via system bus 211. The system bus 211 includes address bus, data bus, control bus, and control line that can transmit a control signal.

Based on program stored in ROM 207, a CPU 203 can communicate to an external device like an image forming apparatus, and can store data on an EEPROM 209 ordered by the external device. System control logic 206 is a circuit storing logic to control an IC tag 201. A ROM 207 works a program memory storing a program. A RAM 208 works a working memory for which a program stored in the ROM 207 works. An EEPROM 209 can store various data as which can be rewritten. It will be explained below about these various data that the EEPROM 209 may store. An EEPROM 210 can store a specific order to store to the EEPROM 209.

An EEPROM 209 as a memory member can be replaced to a non-volatile type memory as another embodiment. For example, the non-volatile type memory can store data, by which a SRAM is backed up by a lithium battery or the like.

Examples of data stored in an EEPROM 209 include:

- information used to control an image forming apparatus using a process unit 108 with an IC tag 201,
- information about a seller of process unit 108 and an image forming apparatus using the process unit 108,
- supporting information for a seller of process unit 108 and an image forming apparatus using the process unit 108,
- information about a user of process unit 108 and an image forming apparatus using the process unit 108,
- supporting information for a user on how to use process unit 108 and an image forming apparatus using the process unit 108,
- information about an amount of time of use of process unit 108,
- information about number of images formed by process unit 108, and
- other printer or consumable information.

In the case that a photoconductive unit 111 and a developing unit 112 are separately used as shown in FIG. 3, a photoconductive unit 111 and/or a developing unit 112 may each store such information. Next, information stated above is detailed below.

Information necessary to control an image forming apparatus using a process unit 108 includes information about a condition to form an image by an image forming apparatus using a process unit 108 with an IC tag 201, e.g., exposing time, a charging value, a developing bias or the like.

Information about seller to sell a process unit 108 and an image forming apparatus using the process unit 108, and information about user to use that, includes information about a seller to sell a process unit 108, e.g., a distributor's name, a contact address, selling date, selling price and/or the like, information about a seller to sell an image forming apparatus using a process unit 108, e.g., a distributor's name, a contact address, selling date, selling price and/or the like, information to specify a user using a process unit 108, e.g., a user name, a contact address and/or the like, and/or information to specify a user using an image forming apparatus using a process unit 108, e.g., a user name, a contact address and/or the like.

Supporting information for a user to use a process unit 108 and an image forming apparatus using the process unit 108, and supporting information for a seller to sell that includes manufacturing information of a process unit 108, e.g., a lot number, manufacturing date, a type, a preservation period and/or the like, a recycling information of a process unit 108, e.g., ID number, starting date for first use, a number of time for image forming, a number of time for recycling, a limit number of time for recycling and/or the like, information for a consumable item in a process unit 108, e.g., a replacing term, a lot number for a toner, manufacturing date, a filling amount of a toner, date to fill a toner, a type of a toner, a preservation period, a number of time for recycling, a limit number of time for recycling and/or the like, and/or alarming information, e.g., trouble by a toner, trouble of a charging value and/or the like.

Information about used time of a process unit 108 includes a total used time of a process unit 108, a limit time of a process unit 108 and/or the like. Information about a number of images formed by a process unit 108 is a total number of images formed, a limit number of image formed and/or the like.

Further, an EEPROM 209 of an IC tag 201 includes an information table 212. The information table 212 may have a variety of storing areas, e.g., a total used time memory 212*a*, a limit used time memory 212*b*, a total copy number memory 212*c*, and a limit copy number memory 212*d*.

A used time memory 212*a* can store a total used time of a process unit 108 as stated above. Such information is based on data from an image forming apparatus using a process unit 108 via a contact-less interface 501 and 202.

A limit used time memory 212*b* can store a limit time of a process unit 108. The limit time may be decided by referring to a limit time of a photoconductive member 102 included as a consumable item in a process unit 108, a limit time when a developing device 105 as a consumable item uses up a toner inside, and/or the like. In the case that a process unit has a plurality of consumable items, the shortest limit time of a consumable item is preferably accessed. Such information is stored before a process unit 108 is shipped out.

A total copy number memory 212*c* can store a total number of image formed by a process unit 108 as stated above. Such information is based on data from an image forming apparatus using a process unit 108 via a contact-less interface 501 and 202.

A limit copy number memory 212*d* can store a limit number of image formed by a process unit 108. The limit number may be decided by referring to a limit number of a photoconductive member 102 included as a consumable item in a process unit 108, a limit number when a developing device 105 as a consumable item uses up a toner inside, and/or the like. In the case that a process unit has a plurality of consumable item, the shortest limit number of a consumable item is preferably accessed. Such information is stored before a process unit 108 is shipped out.

Each process unit 108, e.g., for M (Magenta), C (Cyan), Y (Yellow) and K (Black), mounted in an image forming apparatus includes an IC tag 201 as stated above. Further, the image forming apparatus includes contact-less interfaces 501 corresponding to each IC tag 201 of process unit 108, and can communicate to each IC tag 201 of the process unit 108.

Figure 6:
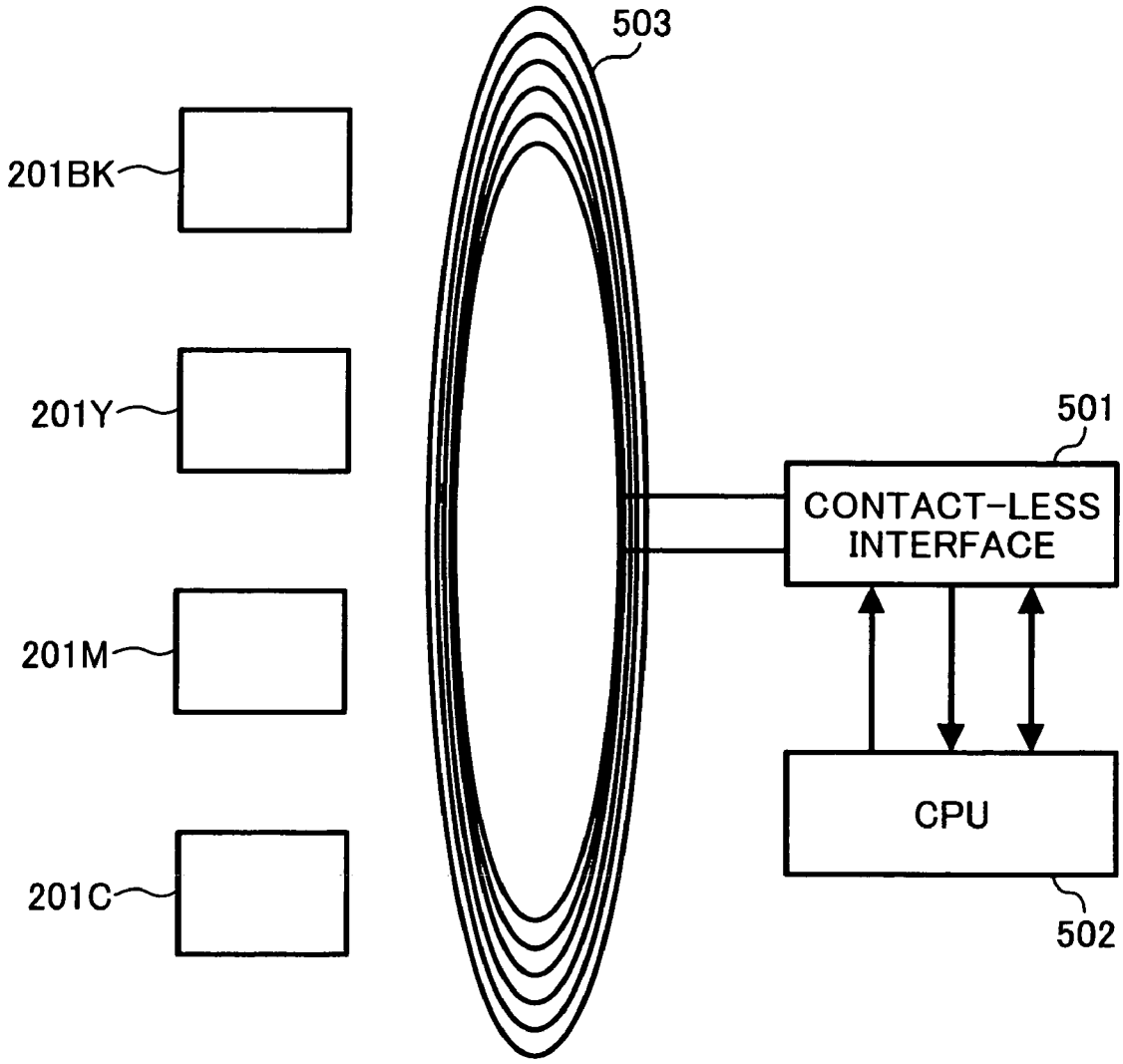
FIG. 6 is a sectional drawing showing another embodiment for a wireless communication between an image forming apparatus and an IC tag.

FIG. 6 is a sectional drawing showing another embodiment for a wireless communication between an image forming apparatus and an IC tag 201. As shown in FIG. 6, the embodiment includes a single contact-less interface 501 in the image forming apparatus. Each four process units 108 for M (Magenta), C (Cyan), Y (Yellow) and K (Black) has a specific address in a corresponding IC tag (201BK, 201Y, 201M, 201C), so that the single contact-less interface 501 can communicate each process unit 108 by designating the address.

Figure 7:
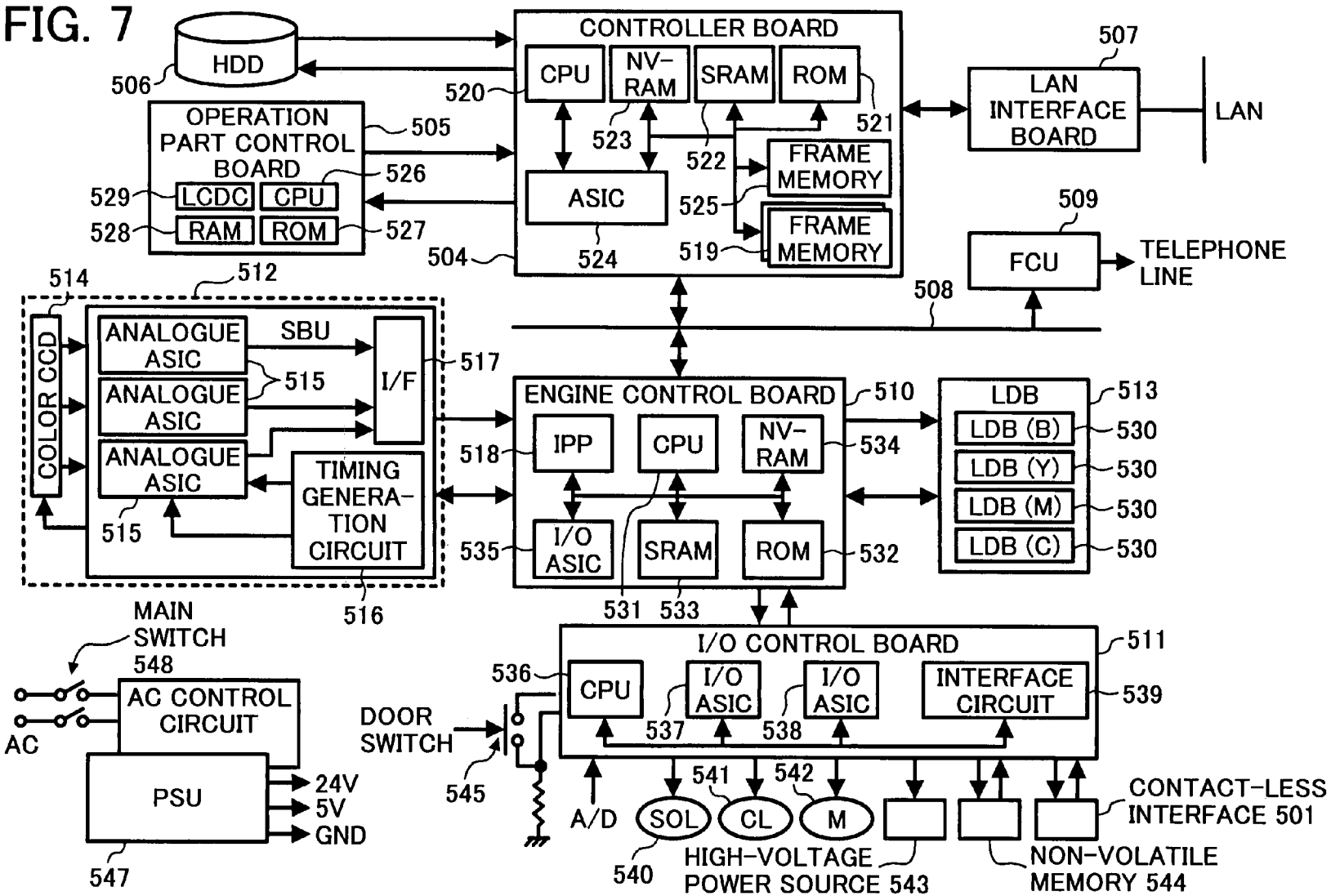
FIG. 7 is a block diagram of an image forming apparatus.

FIG. 7 is a block diagram of an image forming apparatus. As illustrated in FIG. 7, an image forming apparatus includes a controller board 504 configured to control the entire part of the image forming apparatus. To the controller board 504, an operation part control board 505, an HDD 506 to store image information, a LAN interface board 507 configured to connect with a LAN, a facsimile control unit (FCU) 509 connected with a PCI bus 508, an engine control board 510, an I/O control board 511 connected with the engine control board 510, a scanner board (SBU) 512 configured to read an original document, an Laser diode control board (LDB) 513 configured to write image information on the surfaces of the photoconductive member 102 with a laser light, and the like are connected.

A scanner board (SBU) 512 can scan an original document by a light source, and can focus an original image on a color CCD 514. A color CCD 514 is a three-line color CCD, and generates R, G, and B image signals of EVENch/ODDch. The image signals are inputted to analogue ASICs 515 of the scanner board (SBU) 512. The SBU 512 includes a timing generation circuit 516 to generate drive timings for the analogue ASICs and the color CCD 514. Outputs of the color CCD 514 are processed with analogue-to-digital conversion after having been sampled at sample-and-hold circuits in the analogue ASICs. Thereafter, R, G, B image data is processed with shading correction, and is outputted to an image information processor (IPP) 518 of the engine control board 510 via an output I/F 517.

At the IPP 518 of the engine control board 510, various kinds of image processing are performed, such as area determination (determination as to if an area is a character area or a photograph area), removal of background, scanner gamma conversion, filtering, color correction, enlargement and reduction, image editing, printer gamma conversion, gradation processing, etc. The IPP 518 is a programmable calculation device to perform image processing. The image information transmitted to the IPP 518 from the SBU 512 is stored in a frame memory 519 of the controller board 504 after having been processed with correction of signal deterioration.

The controller board 504 includes a frame memory 519, a CPU 520, a ROM 521 configured to control the controller board 504, an SRAM 522 serving as a working memory used by the CPU 520, an NV-RAM 523 including a lithium battery to backup the SRAM 522 and a clock, an ASIC 524 configured to control surroundings of the CPU 520, such as system bus control, frame memory control, FIFO, etc., and a frame memory 525. The clock of the NV-RAM 523 can count 32,768 [Hz] as reference of a crystal inside, and can generate date and time. The CPU 520 can set date and time in an interior register (not shown), inputted by an operation panel (not shown) controlled by an operation part control board 505.

The controller board 504 performs various applications of the image forming apparatus as a multi-function apparatus, such as a scanner application, a facsimile application, a printer application, a copier application, etc., and is configured to control the entire parts of the image forming apparatus. Specifically, the controller board 504 recognizes information concerning an application inputted from the operation part control board 505 and sets a system configuration, and at the same time displays the condition of the system configuration in the display part like LCD and etc, controlled by the operation part control board 505. The operation part control board 505 includes a CPU 526, RON 527, RAM 528, LCDC (ASIC) 529 configured to control to display in a display part and to recognize an input by an operation panel. The ROM 527 stores a control program to control to display in the display part and to recognize the input by the operation panel. The RAM 528 is used as working area when the control program works.

Each color writing signal for M (Magenta), C (Cyan), Y (Yellow) and K (Black), outputted by a frame memory 525 of a controller board 504, inputs to each LD writing circuit 530 of a laser diode control board (LDB) 513. LD electric current control (modulation control) is performed at the LD writing circuits, and the writing signals are outputted to respective LD light sources.

The engine control board 510 mainly performs control of the image forming operation. The engine control board 510 includes an IPP 518 stated above, a CPU 531, a ROM 532 holding programs necessary for the control of the image forming operation, an SRAM 533 necessary for the control of the image forming operation, and NV-RAM 534, and etc. The engine control board 510 further includes I/O ASIC 535. The I/O ASIC is an ASIC to control an I/O, e.g. a counter, a fan, a solenoid, a motor, and etc.

The I/O control board 511 connected with the engine control board 510 by a synchronous serial. The I/O control board 511 includes a CPU 536, I/O ASICs 537 and 538, an interface circuit 539, and can control various solenoid 540, a clutch mechanism 541, a motor 542, a high-voltage power source 543, a non-volatile memory 544, and a contact-less interface 501. Further, the I/O control board 511 connects to a door switch 545 of an image forming apparatus. As an example, if a door of an image forming apparatus opens, the door switch 545 sets an open, and it can recognize that the door opens. In such case, since a process unit 108 may be replaced to new one, the CPU 356 of the I/O control board 511 checks if a process unit 108 has been replaced. The result is transmitted to the engine control board 510.

The interface circuit 539 of the I/O control board 511 can communicate with an IC tag 201 mounted on a process unit 108. The interface circuit 539 connects a contact-less interface 501 by a non-simultaneous serial interface. In such, the contact-less interface 501 can communicate to the IC tag 201 by wireless, as explained above, referring to FIG. 5 and FIG. 6.

The PSU 547 is a unit supplying a power to various devices of an image forming apparatus. By operating a main switch 548, a power is supplied. The I/O control board 511 checks if a process unit 108 has been replaced, when the main switch 548 is operated.

Figure 8:
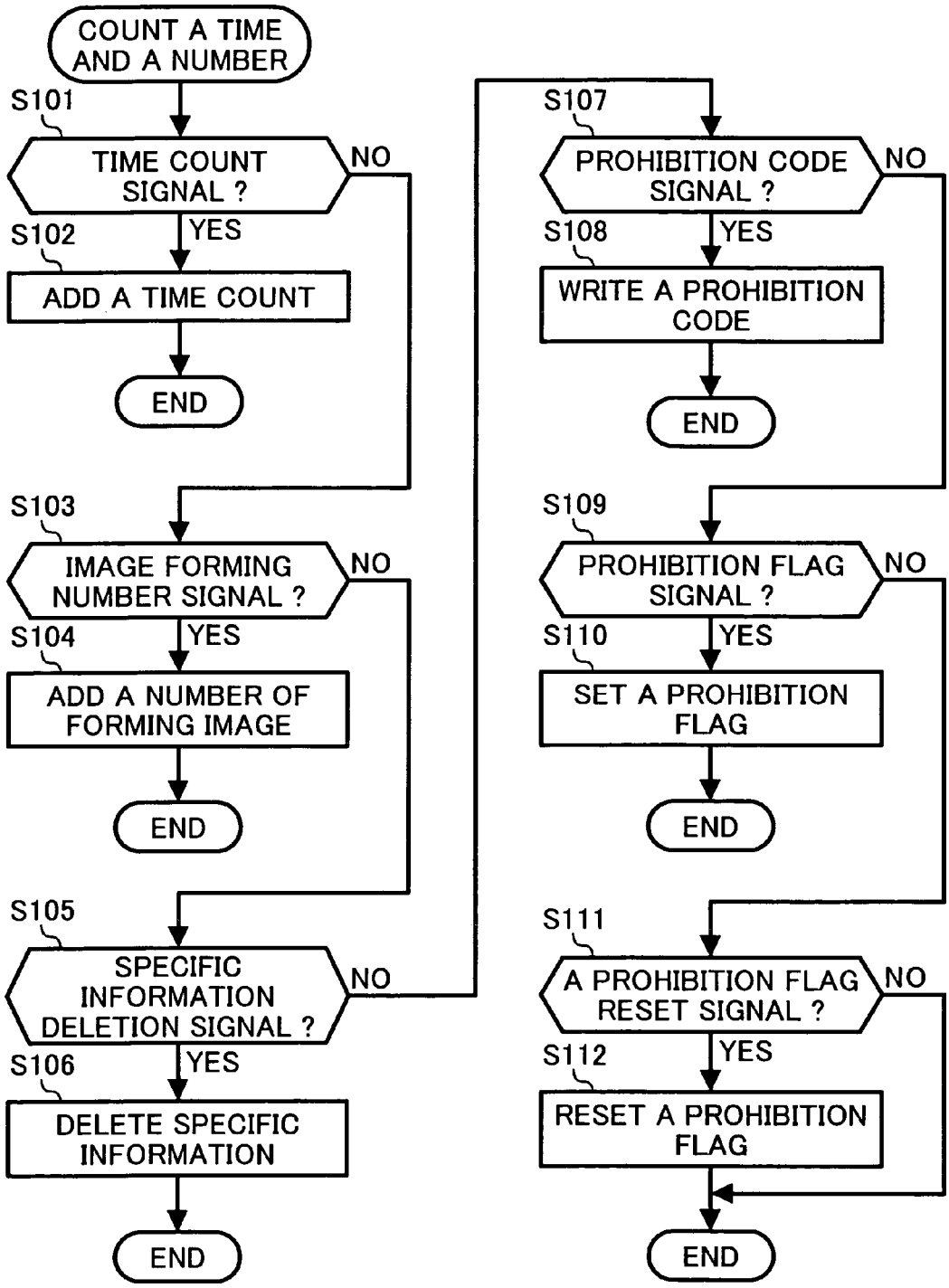
FIG. 8 is a flowchart showing a process used in an IC tag.

FIG. 8 is a flowchart showing a process in an IC tag 201 that is mounted on a consumable item. First, a time management process, an image forming (copy) number management process and a property management process in an image forming apparatus is explained as follows. The image forming number means either of a number of printed sheets, or a number of printed pixel or dots on sheets.

In an image forming apparatus, a CPU 520 of a controller board 504 generates a time count signal per a predetermined time, when is decided by based on a clock of NV-RAM 523. The predetermined time can preferably as a day, an hour, or another period. In this embodiment, an hour is set as a predetermined time. In the image forming apparatus, a CPU 536 of an I/O control board 511 can transmit a time count signal to an IC tag 201 by wireless.

In an image forming apparatus, a CPU 531 of an engine control board 510 manages a number of an image forming (copy). In the image forming apparatus, a CPU 536 of an I/O control board 511 can transmit the number of an image forming (copy) as an image forming number signal to an IC tag 201 by wireless.

Further, an image forming apparatus can manage a property for a process unit 108 by transmitting with IC tag 201, whether a process unit 108 with an IC tag 201 can be used or not. In the case that the image forming apparatus recognizes that a process unit 108 with an IC tag 201 can be no longer used, the image forming apparatus transmits a specific information deletion signal that is a signal for which specific information stored in an EEPROM 209 of an IC tag 201 no longer can be accessed, and a prohibition code signal, so that it transmits a prohibition flag signal showing that a process unit 108 with an IC tag 201 can be no longer used. This process in detailed after, referring to FIG. 9 and FIG. 10.

Referring again to FIG. 8, a process in an IC tag 201 is explained as follows, based on the explanation above about a time management process, an image forming (copy) management process and a property management process for a process unit 108.

A CPU 302 of an IC tag 201 watches whether an image forming apparatus transmits a time count signal (step S101). In the case that the CPU 302 recognizes a receipt of a time count signal (Y in the step S101), it adds "1" to a count stored in a time counter of a used time memory 212*a* in an information table 212 (step S102). After then, the process ends.

In the case that the CPU 302 does not recognize a receipt of a time count signal (N in the step S 101), the CPU 302 watches whether an image forming apparatus transmits an image forming number signal (step S103). In the case that the CPU 302 recognizes a receipt of a time count signal (Y in the step S103), it adds a image forming number received to a count stored in a total copy number of a total copy number memory in an information table 212 (step S104). After then, the process ends.

In the case that the CPU 302 does not recognize a receipt of a time count signal (N in the step S103), the CPU 302 watches whether an image forming apparatus transmits a specific information deletion signal (step S105). In the case that the CPU 302 recognizes a receipt of specific information deletion signal (Y in the step S105), the CPU 302 deletes specific information stored in an EEPROM 209 (step S106). After then, the process ends.

A deletion of specific information is easily made by simply deleting specific information, or by overlapped writing a no-meaning code like "FFH" and etc. on specific information. Various deletion processes can be used according to a physical or technical condition, or the like, of a memory stored in such information.

In the case that the CPU 302 does not recognize a receipt of a specific information deletion signal (N in the step S105), the CPU 302 watches whether an image forming apparatus transmits a prohibition code signal (step S107). In the case that the CPU 302 recognizes a receipt of a prohibition code signal (Y in the step S 107), the CPU 302 writes a prohibition code in an EEPROM 209 (step S108). After then, the process ends.

In the case that the CPU 302 does not recognize a receipt of a prohibition code signal (N in the step S107), the CPU 302 watches whether an image forming apparatus transmits a prohibition flag signal (step S109). In the case that the CPU 302 recognizes a receipt of a prohibition flag signal (Y in the step S109), the CPU 302 sets a prohibition flag in an EEPROM 209 (step S110). After then, the process ends.

In the case that the CPU 302 does not recognize a receipt of a prohibition flag signal (N in the step S109), the CPU 302 watches whether an image forming apparatus transmits a prohibition flag reset signal (step S111). In the case that the CPU 302 recognizes a receipt of a prohibition flag reset signal (Y in the step S111), the CPU 302 resets a prohibition flag in an EEPROM 209 (step S112). After then, the process ends.

As explained above, in the case that a process unit 208 as a consumable item with an IC tag 201 can be no longer used, specific information stored in an EEPROM 209 in the IC tag 201 can no longer be accessed. When specific information can be no longer accessed, in this embodiment, the specific information stored in an EEPROM 209 is deleted (step S106), or a prohibition code in an EEPROM 209 is written (step S108). It is preferably decided whether specific information should be deleted or be prohibited. In both case, specific information stored in an EEPROM 209 in an IC tag 201 can be no longer be accessed becomes not to be referred.

In other embodiments, consumption levels (e.g., toner level, oil level) are measured and used to determine whether the consumable item has reached an end of life. In other embodiments, diagnostic parameters are measured and used to determine if the consumable item is operating within parameters or whether the consumable item has reached an end of life.

Figure 9:
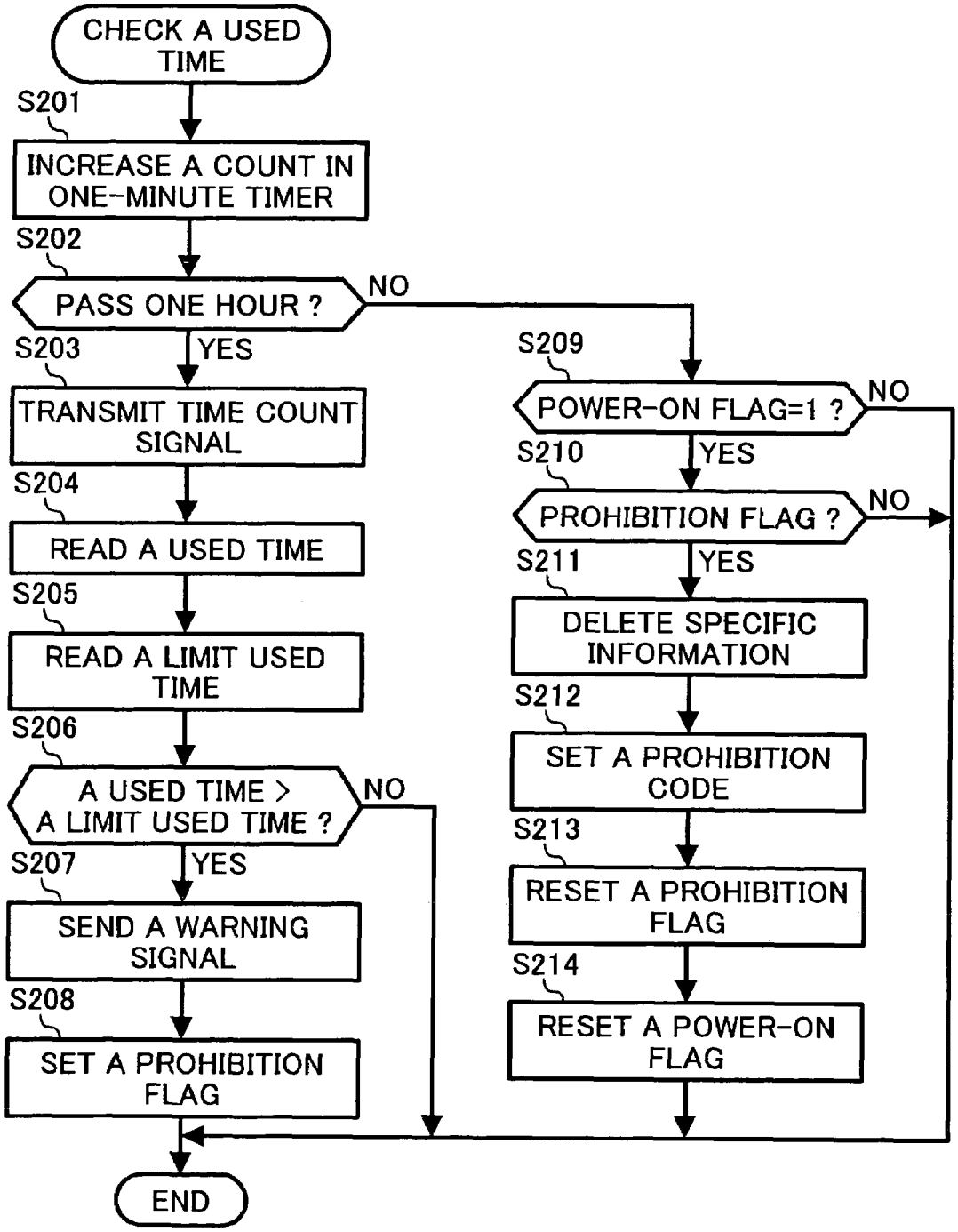
FIG. 9 is a flowchart showing a process for checking a used time for a consumable item.

FIG. 9 is a flowchart showing a process for checking a used time for a consumable item of an image forming apparatus. A CPU 520 of a controller board 504 increases a count in one-minute timer stored in working area of SRAM 522 by counting to pass one minute (step S201). The CPU 520 recognizes whether one hour passes or not, referring to a count value in the one-minute timer (step S202). In the case that the CPU 520 recognizes to pass one hour (Y in the step S202), the CPU 520 makes a CPU 536 of an I/O control board 511 to transmit a time count signal to an IC tag 201 (step S203). As such, the IC tag 201 recognizes a receipt of the time count signal as shown a flowchart in FIG. 8 (Y in the step S101), then it adds "1" to a count stored in a time counter of a used time memory 212*a* in an information table 212 (step S102). Therefore, by which a used time memory 212*a* is accessed, a total used time of a process unit 108 with an IC tag 201 can be realized.

After then, the CPU 520 of a controller board 504 makes a CPU 536 of an I/O control board 511 to refer an information table 212 in an IC tag 201, so that it reads a total used time from a total used time memory 212*a*, and a limit used time from a limit used time memory 212*b* (step S204 and S205). After then, the CPU 520 compares the total used time with the limit used time (step S206). In the case that the CPU 520 recognizes that the total used time exceeds the limit used time (Y in the step S206), the CPU 520 sends a warning signal (step S207). Therefore, an image forming apparatus displays (or alarms) a warning to a user that a process unit 108 with an IC tag 201 can be no longer used. After then, the CPU 520 transmits a prohibition flag signal to the IC tag 201 (step S208). As such, the IC tag 201 recognizes a receipt of the prohibition flag signal as shown a flowchart in FIG. 8 (Y in the step S109), then the CPU 302 sets a prohibition flag in an EEPROM 209 (step S110).

In the case that the CPU 520 of the controller board 504 does not recognize to pass one hour (N in the step S202), the CPU 520 watches whether a power-on flag sets (step S209). The power-on flag is set when an image forming apparatus is powered on. In the case that the CPU 520 does not recognize that the power-on flag sets (N in the step S209), the process ends. Contrary, in the case that the CPU 520 recognize that the power-on flag sets (Y in the step S209), the CPU 520 makes a CPU 536 of an I/O control board 511 to transmit with an IC tag 201, then to recognize whether a prohibition flag sets in an EEPROM 209 of an IC tag 201 (step S210). In the case that the CPU 520 does not recognize that a prohibition flag sets (N in the step S210), the process ends. Contrary, in the case that the CPU 520 recognizes that a prohibition flag sets (Y in the step S210), it means that a process unit 108 of an IC tag 201 can be used no longer. Therefore, in the case that the CPU 520 recognizes that a prohibition flag sets (Y in the step S210), the CPU 520 makes an CPU 536 of an I/O control board 511 to transmit a specific information deletion signal and a prohibition code signal to an IC tag 201 (step S211 and S212). As result, in the IC tag 201, the CPU 302 deletes specific information stored in an EEPROM 209 (step S106), and writes a prohibition code in an EEPROM 209 (step S108), as shown in a flowchart in FIG. 8, thus maintaining security and privacy.

After then, the CPU 520 of the controller board 504 makes a CPU 536 of an I/O control board 511 to transmit a prohibition flag reset signal to an IC tag 201 (step S213). In the IC tag 201, the CPU 302 resets a prohibition flag in an EEPROM 209 (step S112) as shown a flowchart in FIG. 8. As such, a process unit 108 with an IC tag 201 can be reused. As explained, since specific information in an IC tag 201 can be no longer accessed, security can be stably maintained.

After that, the CPU 520 of the controller board 504 resets a power-on flag (step S214).

Figure 10:
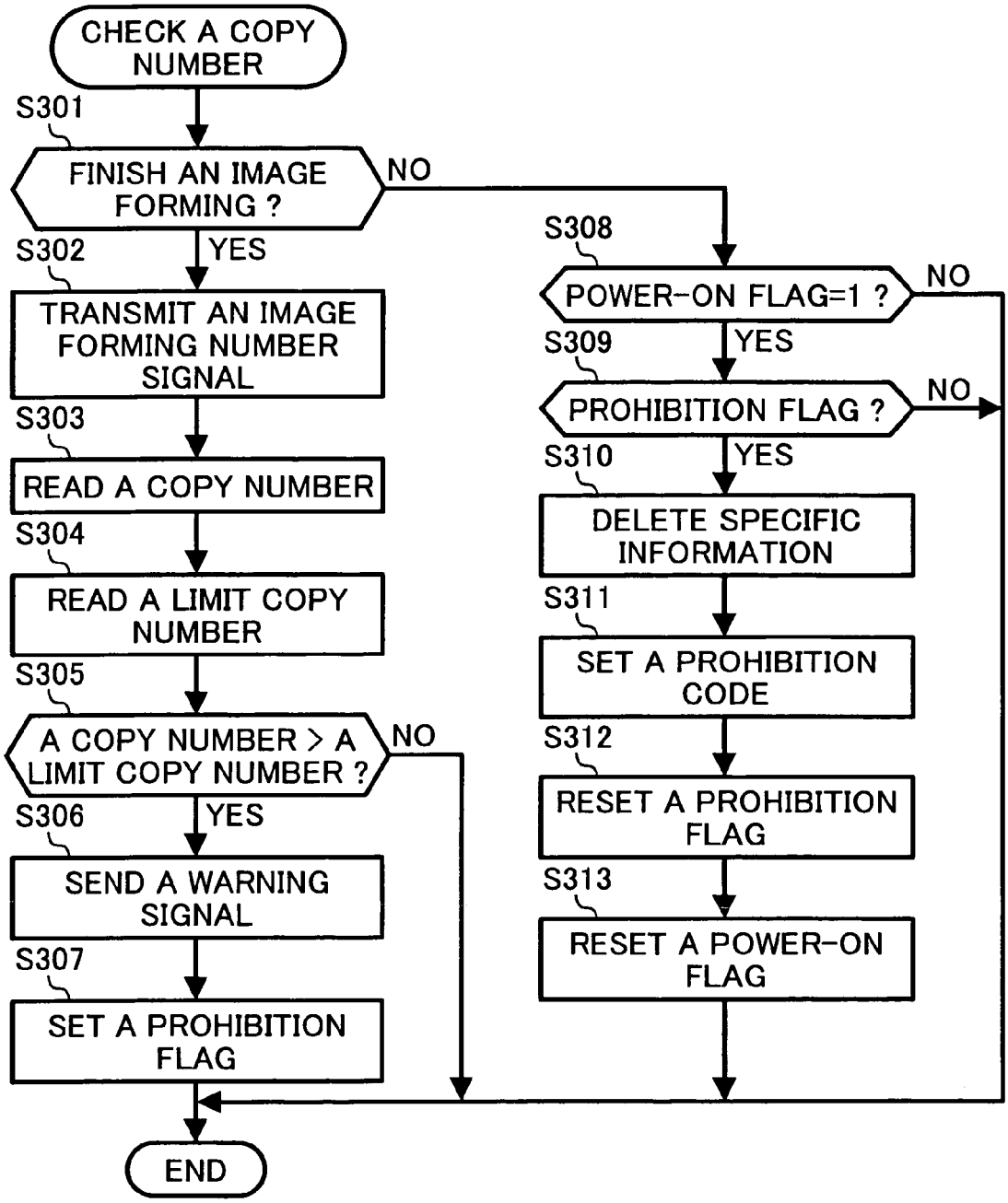
FIG. 10 is a flowchart showing a process for checking a number of an image forming (copy) for a consumable item.

FIG. 10 is a flowchart showing a process for checking a number of an image forming (copy) for a consumable item used in an image forming apparatus. A CPU 520 of a controller board 504 watches whether a job for forming an image is finished, e.g. an image is formed on a recording medium (step S301). In the case that the CPU 520 recognized that the job is finished (Y in the step S301), the CPU 520 makes a CPU 536 of the I/O control board 511 to transmit an image forming number signal to an IC tag 201 (step S302). As such, in the IC tag 201, the CPU 302 recognizes a receipt of the image forming number signal (Y in the step S103), it adds a image forming number received to a count stored in a total copy number of a total copy number memory 212*c* in an information table 212 (step S104), as shown a flowchart in FIG. 8. Therefore, by which a total copy number memory 212*c* is accessed, a total image forming number of a process unit 108 with an IC tag 201 can be realized.

After then, the CPU 520 of the controller board 504 makes the CPU 536 of the I/O control board 511 to refer an information table 212 stored in an EEPROM 209 in an IC tag 201, and to read a total copy number from a total copy number memory 212*c*, and a limit copy number from a limit copy number memory 212*d* (step S303 and S304). After then, the CPU 520 compares the total copy number with the limit copy number (step S305). In the case that the CPU 520 recognizes that the total copy number exceeds the limit copy number (Y in the step S305), the CPU 520 sends a warning signal (step S306). Therefore, an image forming apparatus displays (or alarms) a warning to user that a process unit 108 with an IC tag 201 can be no longer used. After then, the CPU 520 transmits a prohibition flag signal to the IC tag 201 (step S307). As such, the IC tag 201 recognizes a receipt of the prohibition flag signal as shown a flowchart in FIG. 8 (Y in the step S109), then the CPU 302 sets a prohibition flag in an EEPROM 209 (step S110).

The CPU 520 of the controller board 504 does not recognize that the job for forming an image is finished (N in the step S301), the CPU 520 watches a power-on flag sets (step S308). The power-on flag is set when an image forming apparatus is powered on.

In the case that the CPU 520 does not recognize that the power-on flag sets (N in the step S308), the process ends. Contrary, in the case that the CPU 520 recognizes that the power-on flag sets (Y in the step S308), the CPU 520 makes CPU 536 of an I/O control board 511 transmit with an IC tag 201, then to recognize whether a prohibition flag sets in an EEPROM 209 of an IC tag 201 (step S309). In the case that the CPU 520 does not recognize that a prohibition flag sets (N in the step S308), the process ends. Contrary, in the case that the CPU 520 recognizes that a prohibition flag sets (Y in the step S309), it means that a process unit 108 of an IC tag 201 can be no longer used. Therefore, in the case that the CPU 520 recognizes that-a prohibition flag sets (Y in the step S309), the CPU 520 makes an CPU 536 of an I/O control board 511 to transmit a specific information deletion signal and a prohibition code signal to an IC tag 201 (step S310 and S311). As result, in the IC tag 201, the CPU 302 deletes specific information stored in an EEPROM 209 (step S106), and writes a prohibition code in an EEPROM 209 (step S108), as shown in a flowchart in FIG. 8, thus maintaining security and privacy.

After then, the CPU 520 of the controller board 504 makes a CPU 536 of an I/O control board 511 to transmit a prohibition flag reset signal to an IC tag 201 (step S312). In the IC tag 201, the CPU 302 resets a prohibition flag in an EEPROM 209 (step S112) as shown a flowchart in FIG. 8. As such, a process unit 108 with an IC tag 201 can be reused. As explained, since specific information in an IC tag 201 can be no longer accessed, security can be stably maintained.

After that, the CPU 520 of the controller board 504 resets a power-on flag (step S313).

Figure 11:
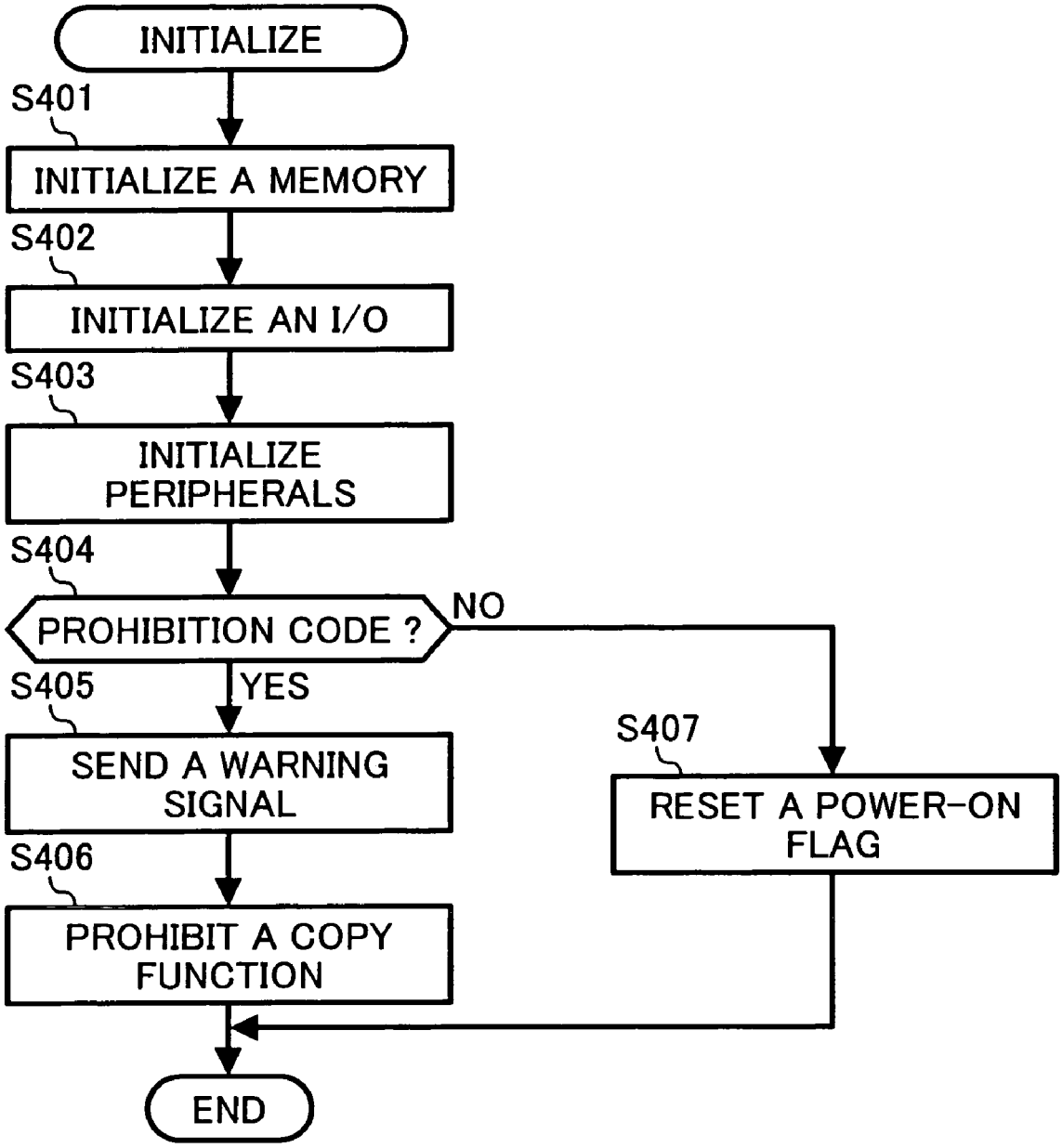
FIG. 11 is a flowchart showing an initializing process for an image forming apparatus.

FIG. 11 is a flowchart showing an initializing process for an image forming apparatus. An initializing process is made when an image forming apparatus is powered on. In this case, a CPU 520 checks whether a process unit 108 can be used or not. That is, the CPU 520 clears and initiates a memory of a SRAM 522 and etc in an image forming apparatus (step S401), and initiates an I/O related device in the image forming apparatus (step S402), and then initiates peripherals connected to the image forming apparatus (step S403).

Next, the CPU 520 reads information from an EPPROM 209 as memory of an IC tag, and checks whether there is a prohibition code or not (step S404). As result, in the case that the CPU 520 does not recognize that a prohibition code is not written (N in the step S404), the CPU 520 resets a power-on flag (step S407). Contrary, in the case that the CPU 520 recognizes that a prohibition code is written (Y in the step S404), the CPU 520 sends a warning signal (step S405). Therefore, an image forming apparatus displays (or alarms) a warning to user that a process unit 108 with an IC tag 201 can be no longer used. Further, for example, a color of a copy button in an operation panel changes to red, and a copy function is prohibited (step S406).

Figure 12:
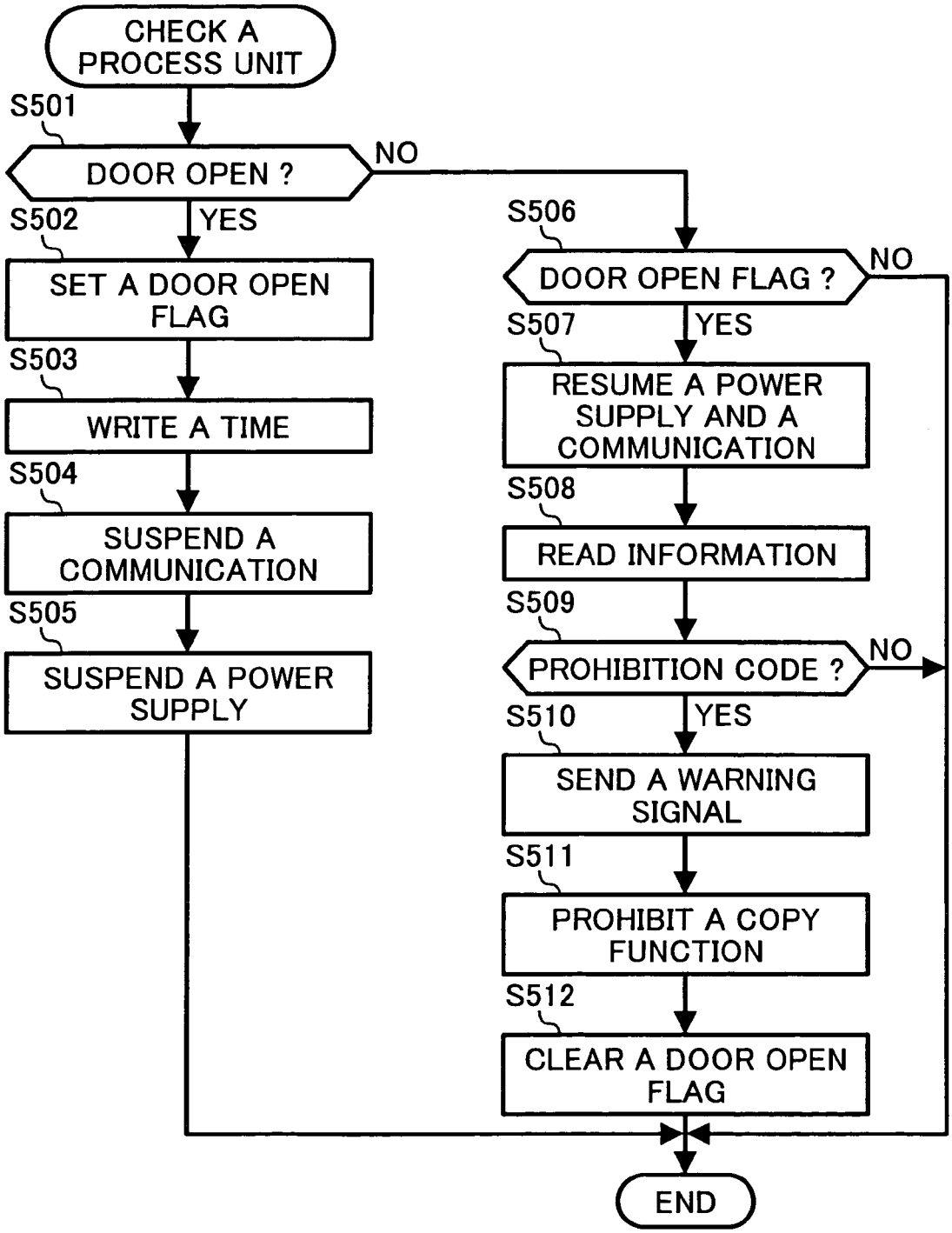
FIG. 12 is a flowchart showing a process when a door in an image forming apparatus opens.

FIG. 12 is a flowchart showing a process when a door in an image forming apparatus opens. If a door in an image forming apparatus (not shown) opens, a process unit 108 may be replaced to new one. Therefore, in the case that a door opens, an image forming apparatus checks whether a process unit 108 can be used or not. First, a CPU 536 of an I/O control board 511 checks whether a door opens (step S501). As result, in the case that the CPU 356 recognizes that a door opens (Y in the step S501), for example, the CPU 356 sets a door open flag in an SRAM 522 of a controller board 504 (step S502). Next, the CPU 520 of a controller board 504 makes a CPU 536 of the I/O control board 511 to transmit with an IC tag 201, and to write a time stored in a NV-RAM 523 in an EEPROM 209 as memory in the IC tag 201 (step S503). After that, a communication with the IC tag 201 suspends (step S504), and then the CPU 520 suspends to supply a power to the IC tag 201 (step S505). When a power to the IC tag 201 is suspended to supply, for example, an I/O control board 511 outputs "1" as a suspending signal.

Next, in the case that the CPU 536 does not recognize that door opens (N in the step S501), the CPU 536 checks whether a door open flag is written or not (step S506). In the case that the CPU 536 recognizes that a door open flag is written (Y in the step S506), this means that a door opens and closes. In this case, for which a power to the IC tag 201 resumes to supply, for example, an I/O control board 511 outputs "0" as a resuming signal, and then a communication between an image forming apparatus and an IC tag 201 resumes (step S507). Next, the CPU 520 reads information from an EPPROM 209 as memory of an IC tag (step S508), and checks whether there is a prohibition code or not (step S509). As result, in the case that the CPU 520 does not recognize that a prohibition code is not written (N in the step S509), the process ends. Contrary, in the case that the CPU 520 recognizes that a prohibition code is written (Y in the step S509), the CPU 520 sends a warning signal (step S510). Therefore, an image forming apparatus displays (or alarms) a warning to a user that a process unit 108 with an IC tag 201 can be no longer used. Further, for example, a color of a copy button in an operation panel changes to red, and a copy function is prohibited (step S511). After that, the CPU 520 resets a power-on flag, and then the process ends (step S512).

Next, another preferred embodiment of the present invention is explained as below, referring to FIG. 13 and FIG. 14. In an embodiment stated above, a CPU 502 in an image forming apparatus, i.e. a CPU 520 of a controller board 504, can recognize whether a process unit 108 with an IC tag 201 can be used or not, so that it can make that information stored in an EEPROM 209 of an IC tag 201 can be accessed no longer. However, in this embodiment, a CPU 203 of an IC tag 201 in a process unit 108 can make such a process.

Figure 13:
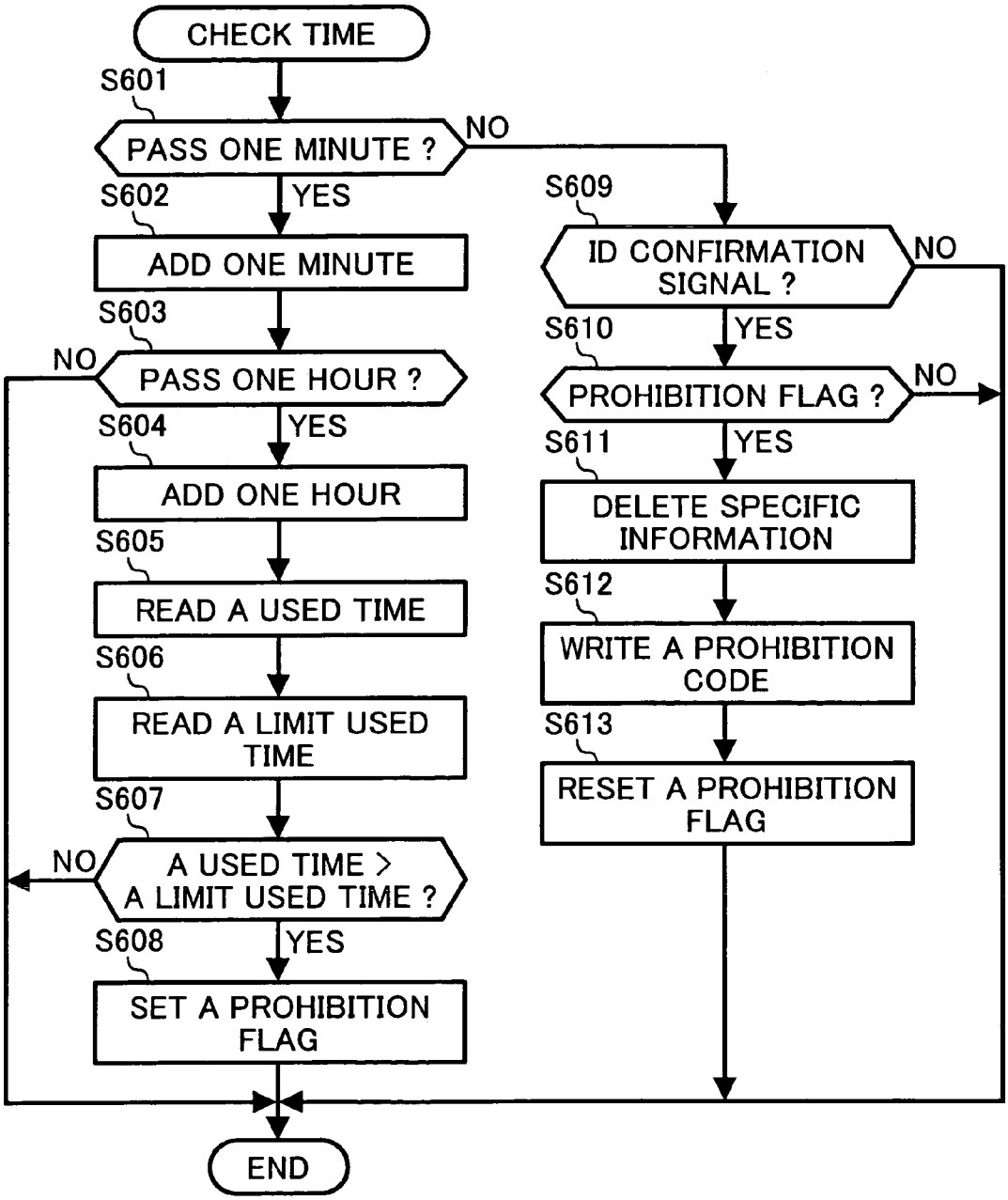
FIG. 13 is a flowchart showing a process in a CPU 203 of an IC tag 201.

FIG. 13 is a flowchart showing a process that a CPU 203 of an IC tag 201 in a process unit 108 as a consumable item recognizes whether a process unit 108 with the IC tag 201 can be used or not, by referring a used time of a process unit 108, and then the CPU 203 makes that information can be accessed no longer, based on the result. A CPU 203 of an IC tag 201 watches whether one minute passes, by referring a one-minute counter in an inside of the CPU 203 (step S601). In the case that the CPU 203 recognizes that one minute passes, it adds "1" to a count value of a one-minute counter in a RAM 208 (step S602). Information stored in a RAM 208 is not maintained when a power is off. Therefore, in the case that this counter counts one hour (Y in the step 603), the CPU 203 adds one hour to a time counter of a used time memory 212*a* in the IC tag 201 (step S604). The used time memory 212*a* in an information table 212 is made of a non-volatile memory, therefore a count value is maintained after a power is off, and the used time can be continuously added.

Next, the CPU 203 reads a used time stored in the used time memory 212*a* (step S605), and reads a limit used time from a limit used time memory 212*b* that is preset in the limit used memory 212*b* (step S606). After then, the CPU 203 compares the total used time with the limit used time (step S607). In the case that the CPU 203 recognizes that the total used time exceeds the limit used time (Y in the step S607), since the CPU 203 recognize that the process unit 108 can be no longer used, the CPU 203 sets a prohibition flag for a process unit 108 (step S608). In the case that the CPU 203 does not recognize that the total used time exceeds the limit used time (N in the step S607), the process ends.

In the case that the CPU 203 does not recognize to pass one minute (N in the step S601), the CPU 203 watches whether there is a receipt of an ID confirmation signal for a process unit 108 that is sent by a CPU 502 in an image forming apparatus (step S609). The ID confirmation signal for a process unit is a signal for a confirmation of ID information for a process unit that is transmitted by an image forming apparatus when a door opens and closes or a power is on, because a process unit 108 may be replaced to new one. After confirmed the ID information, an image forming apparatus can display (or alarm) a warning to a user that a process unit 108 can be no longer used, or can change a color of a copy button in an operation panel and can prohibit a copy function.

In the case that the CPU 203 recognizes a receipt of the ID confirmation signal (Y in the step S609), the CPU 203 checks whether a prohibition flag sets in an IC tag 201 (step S610). In the case that the CPU 203 recognizes that a prohibition flag sets (Y in the step S610), the CPU 203 deletes specific information stored in an EEPROM 209 (step S611). A deletion of specific information is easily made by simply deleting specific information, or by overlapped writing a no-meaning code like "FFH" and etc. on specific information. Various deletion processes can be used according to a physical or technical condition, or the like, of a memory stored in such information. Next, the CPU 203 writes a prohibition code in an EEPROM 209 in the IC tag 201 (step S612). Then, the CPU 203 resets a prohibition flag in an EEPROM 209 (step S613), and the process ends.

As explained above, in the case that a process unit 208 as a consumable item with an IC tag 201 can be no longer used, specific information stored in an EEPROM 209 in the IC tag 201 can be accessed no longer on a basis of a used time. When specific information can be accessed no longer, in this embodiment, the specific information stored in an EEPROM 209 is deleted (step S611), or a prohibition code in an EEPROM 209 is written (step S612). It is preferably decided whether specific information should be deleted or be prohibited. In both case, specific information stored in an EEPROM 209 in an IC tag 201 can be accessed no longer, thus maintaining security and privacy.

Figure 14:
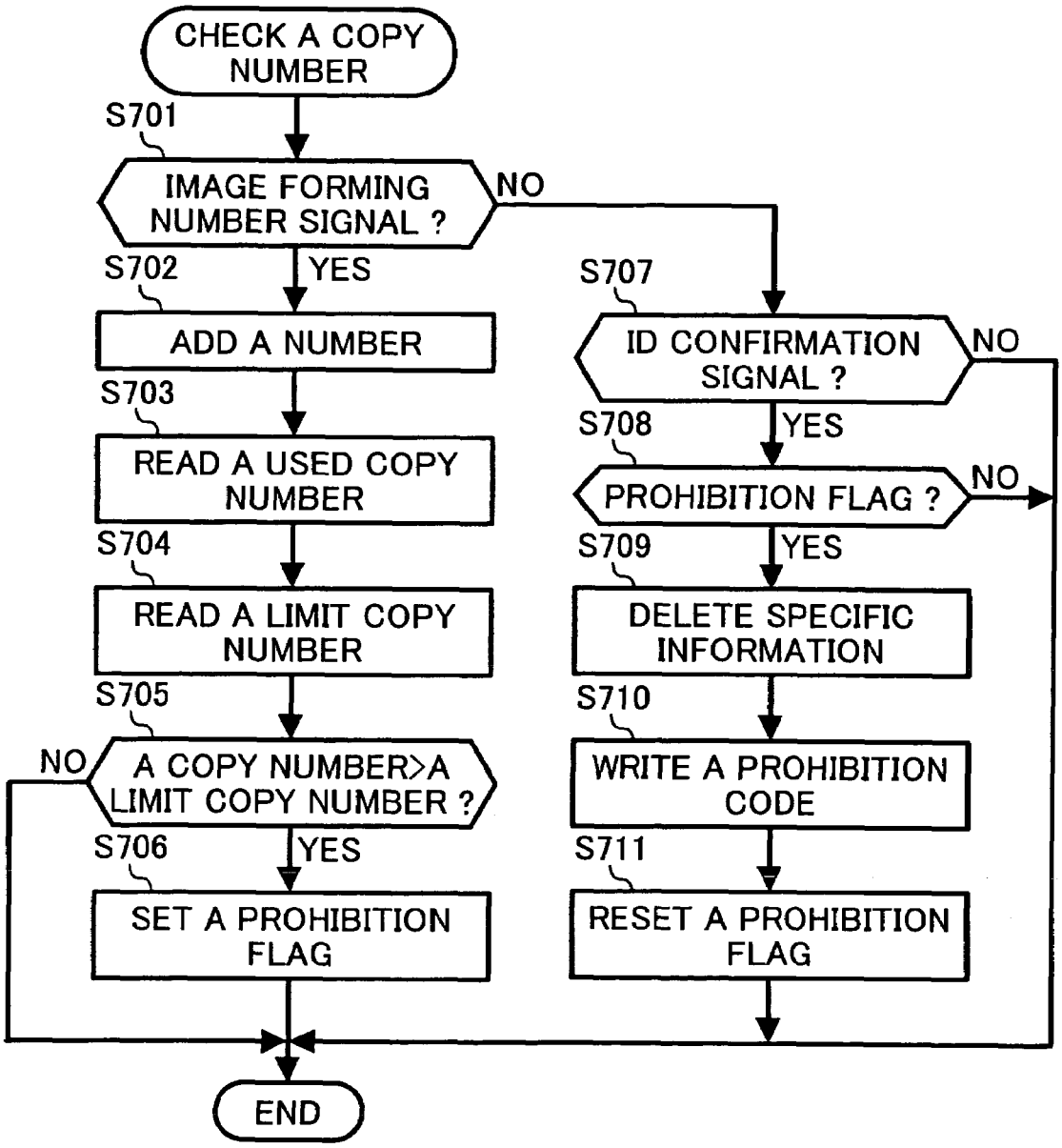
FIG. 14 is a flowchart showing another process in a CPU 203 of an IC tag 201.

FIG. 14 is a flowchart showing a process that a CPU 203 of an IC tag 201 in a process unit 108 as a consumable item recognizes whether a process unit 108 with the IC tag 201 can be used or not, by referring a number of an image forming (copy) for a process unit 108, and then the CPU 203 makes that information can be accessed no longer, based on the result. First, a CPU 203 recognizes a receipt of an image forming number signal from an image forming apparatus (step S701). In the case that the CPU 203 recognizes a receipt of the image forming number signal (Y in the step S701), the CPU 203 adds the image forming number received to a count stored in a total copy number memory 212*c* (step S702).

Next, the CPU 203 reads a total copy number from a total copy number memory 212*c* (step S703), and reads a limit copy number from a limit copy number memory 212*d* (step S704). After then, the CPU 520 compares the total copy number with the limit copy number (step S705). In the case that the CPU 203 recognizes that the total copy number exceeds the limit copy number (Y in the step S705), since the CPU 203 recognize that the process unit 108 can be no longer used, the CPU 203 sets a prohibition flag for a process unit 108 (step S706). In the case that the CPU 203 does not recognize that the total copy number does not exceed the limit copy time (N in the step S705), the process ends.

In the case that the CPU 203 does not recognize a receipt of a copy number signal from an image forming apparatus (N in the step S701), the CPU 203 watches whether there is a receipt of an ID confirmation signal for a process unit 108 that is sent by a CPU 502 in an image forming apparatus (step S707). The ID confirmation signal for a process unit is a signal for a confirmation of ID information for a process unit that is transmitted by an image forming apparatus when a door opens and closes or a power is on, because a process unit 108 may be replaced to new one. After confirmed the ID information, an image forming apparatus can display (or alarm) a warning to a user that a process unit 108 can be no longer used, or can change a color of a copy button in an operation panel and can prohibit a copy function.

In the case that the CPU 203 recognizes a receipt of the ID confirmation signal (Y in the step S707), the CPU 203 checks whether a prohibition flag sets in an IC tag 201 (step S708). In the case that the CPU 203 recognizes that a prohibition flag sets (Y in the step S708), the CPU 203 deletes specific information stored in an EEPROM 209 (step S709). A deletion of specific information is easily made by simply deleting specific information, or by overlapped writing a no-meaning code like "FFH" and etc. on specific information. Various deletion processes can be used according to a physical or technical condition, or the like, of a memory stored in such information. Next, the CPU 203 writes a prohibition code in an EEPROM 209 in the IC tag 201 (step S710). Then, the CPU 203 resets a prohibition flag in an EEPROM 209 (step S711), and the process ends.

As explained above, in the case that a process unit 208 as a consumable item with an IC tag 201 can be no longer used on a basis of an image forming number, specific information stored in an EEPROM 209 in the IC tag 201 can be accessed no longer. When specific information can be accessed no longer, in this embodiment, the specific information stored in an EEPROM 209 is deleted (step S709), or a prohibition code in an EEPROM 209 is written (step S710). It is preferably decided whether specific information should be deleted or be prohibited. In both case, specific information stored in an EEPROM 209 in an IC tag 201 can be accessed no longer, thus maintaining security and privacy.

In embodiments stated above, a consumable item shows a process unit 108, a photoconductive unit 111 or a developing unit 122. However, it is utilized to a fixing unit or a various device as a consumable item, as explained next.

Figure 15:
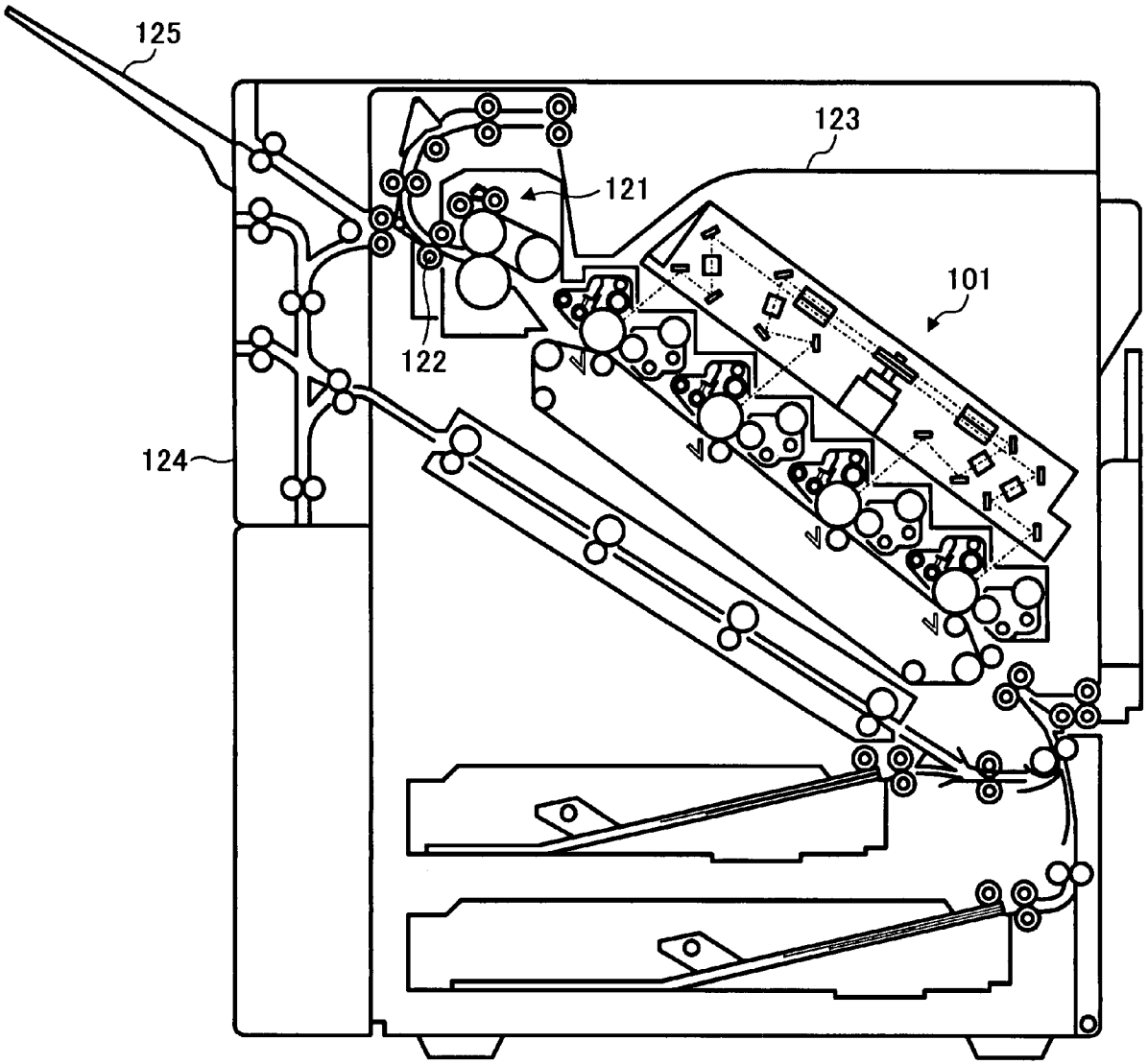
FIG. 15 is a sectional drawing showing a fixing device in an image forming apparatus.

FIG. 15 is a sectional drawing showing an image forming apparatus that includes an image processing device 101 and a fixing device 121. The image processing device 101 is substantially same with embodiments stated above. A recording medium is formed an image by the image processing device 101, and is conveyed to the fixing device 121. In the fixing device 121, the image is fixed on the recording medium by a pressure and a heat. After then, the recording medium is discharged to a tray 123 on an upper surface of the image forming apparatus, or is discharged to a tray 125 or a finisher (not shown) via a double-side printing unit 124.

Figure 16:
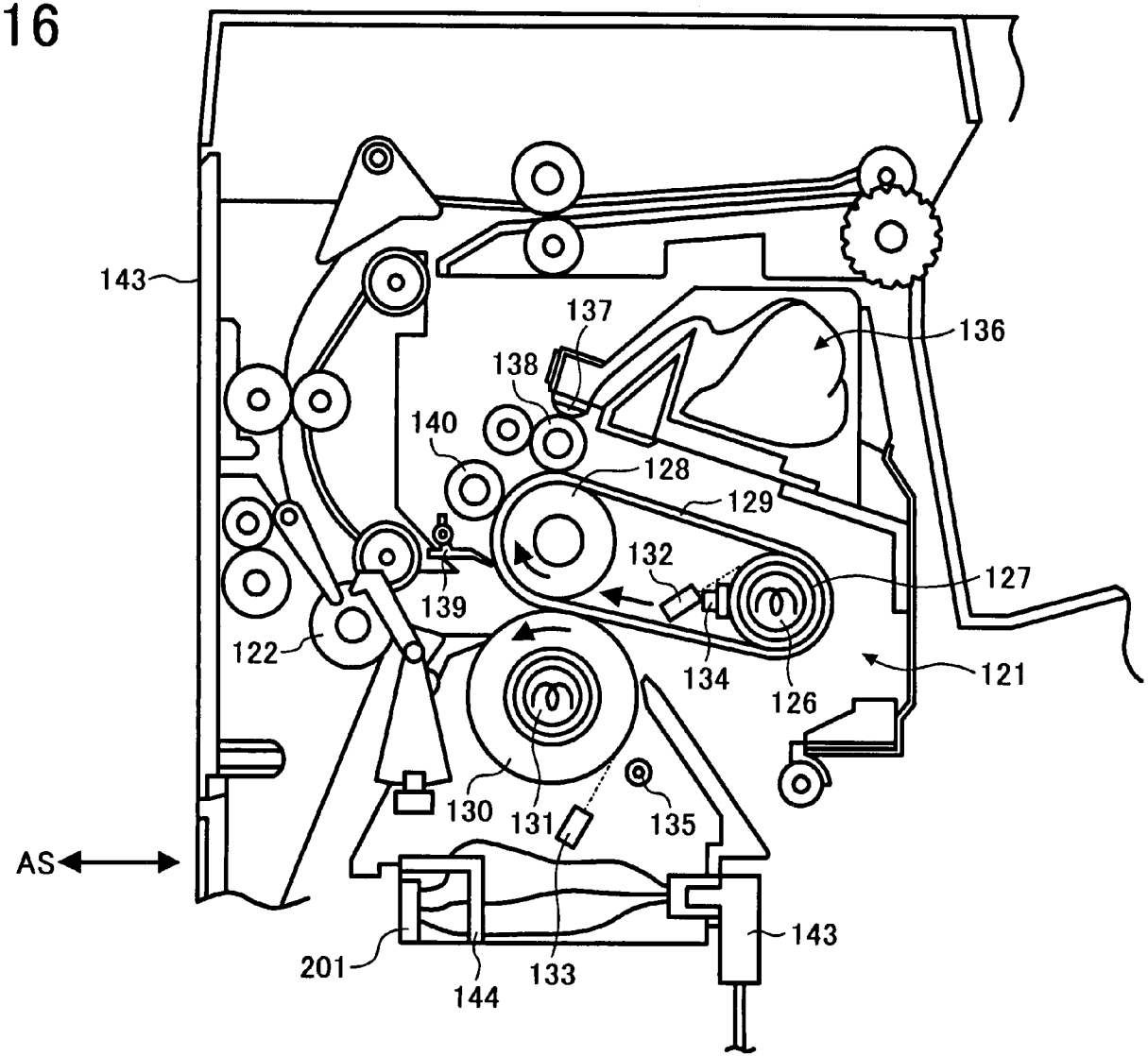
FIG. 16 is a partial sectional drawing showing a fixing device.

FIG. 16 is a partial sectional drawing showing a fixing device 121 as a consumable item. A fixing device 121 mainly includes a heating roller 127 mounted a halogen heater 126 inside as a heating source, a fixing belt 129 stretched by the heating roller 127 and a fixing roller 128, a presser roller 130 pressed toward the fixing roller 128, and forming a nip with the fixing roller 128 via the fixing belt 129. In this embodiment, another halogen heater 131 is also mounted inside of the pressure roller 139. A first thermistor 132 and a second thermistor 133 are mounted to contact with the heating roller 127 and the pressure roller 130, and measure temperature of a surface of these rollers 127 and 130. Further, based on the temperature measured, a heating temperature is controlled to maintain a preferable one. Also, a thermostat 134 and a fuse 135 are mounted near to maintain safety in the case that a temperature controller stated above is damaged. Further, an oil coating unit 136 filling oil as consumable item is mounted in an upper of the fixing belt 129. The oil coating unit 136 includes an oil coating felt 137, an oil coating roller 138 and etc., and can coat oil on a surface of the fixing belt 129 via the oil coating felt 137 and the oil coating roller 138. Since a fixing belt 129 is coated by oil, a recording medium formed an image can be easily separated from a fixing belt 129. A separating claw 139 is moveably mounted between a contacting position which contacts to the fixing belt 129, and a departing position which departs from the fixing belt 129, as shown FIG. 16, so that a recording medium can be easily separated from a fixing belt 129 after fixed. A cleaning roller 140 is mounted to contact with the fixing belt 129 in just front of the coating roller 138, so that it can remove an offset toner remained on a surface of the fixing belt 129.

Oil as a consumption element goes fewer according to a number of a used recording medium (a number of fixing). Therefore, it is necessary to replace it to new one when oil used up. For that, in this embodiment, a fixing unit 121 themselves can be replaced. However, for example, in the case that other parts have a longer lifetime, only an oil coating unit 136 can be replaced. For replacing, a fixing unit 121 is guided by guide members of an image forming apparatus (not shown), and can be detachable in a direction as shown in FIG. 16. The fixing unit 121 further includes a draw connector 142 that detachably connects to a connector 141 of an image forming apparatus, and a halogen heater 126 and 131 can be powered.

A fixing unit 121 includes an IC tag 201 as same with a process unit 108, a photoconductive unit 111, and a developing unit 122, in another embodiment. The IC tag 201 is mounted on an exterior of a unit frame 143 of the fixing unit 121 as shown in FIG. 16, and is surrounded by a heat insulator 144 that is made of ceramics and etc. having lower heat conductively, so that the IC tag 201 is isolated from a space including a pressure roller 130. Therefore, heat effect to an IC tag 201 can decrease. Also, the IC tag 201 connects (or communicates) to a controller board of an image forming apparatus (not shown) via a draw connector 142, a connector and etc., or by wireless, and can write or delete information as same with another embodiment.

Figure 17:
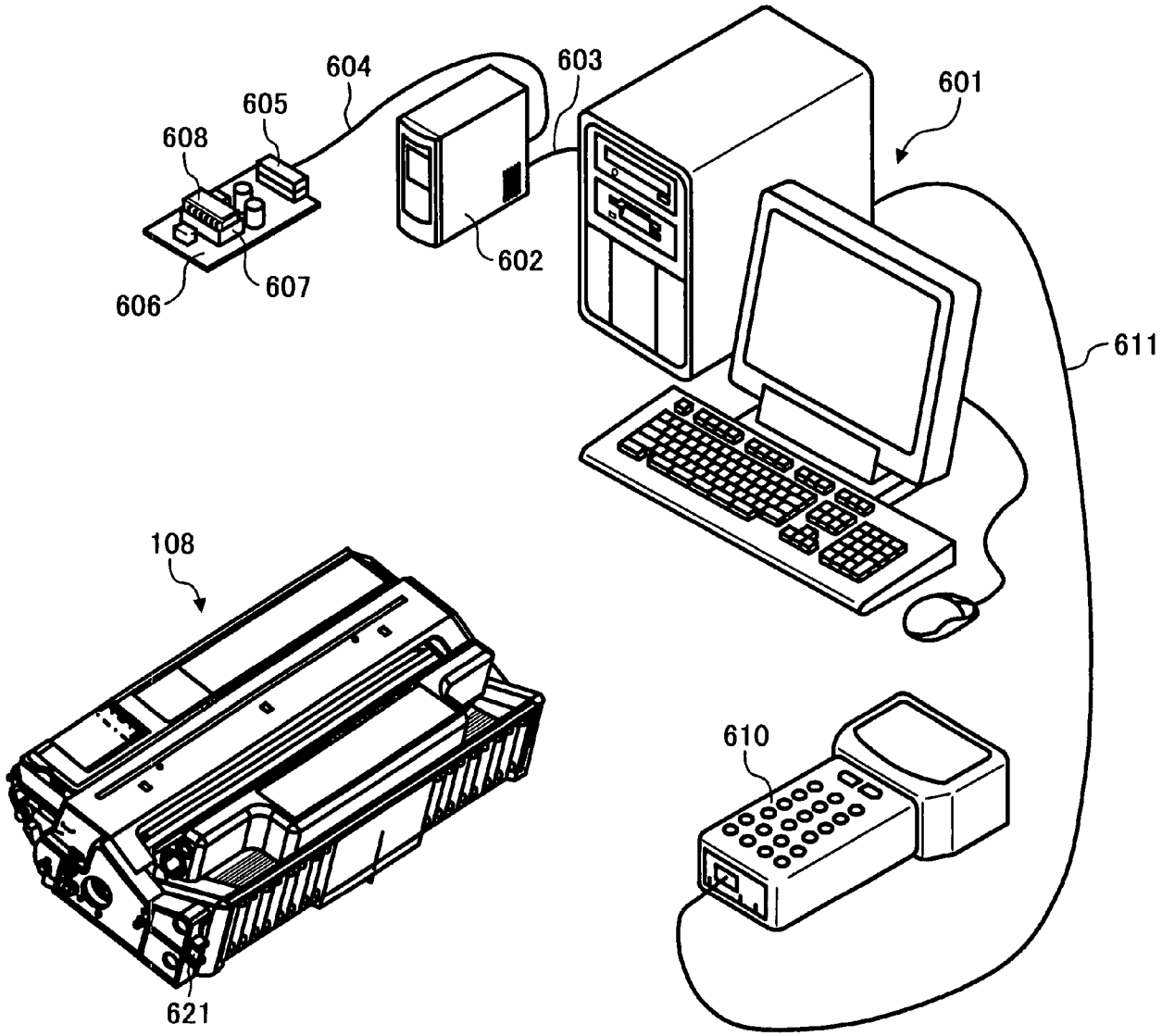
FIG. 17 is a perspective drawing showing a system that can store recycling information on an EEPROM 209 in an IC tag 201, and/or read recycling information from an EEPROM 209 in an IC tag 201.

FIG. 17 is a perspective drawing showing an example for a system that can store recycling information on an EEPROM 209 in an IC tag 201, and/or can read recycling information from an EEPROM 209 in an IC tag 201. An IC tag read/write device 602 connects to a computer 601 via a USB cable 603 as an example. Any standard for connecting with a computer can be used. Also, the IC tag read/write device 602 connects to an IC tag read/write board 606 via a connector 605 of an 12C bus (Inter IC bus) 604. The IC tag read/write board 606 includes a socket 607 that can detachably mount an IC tag 201. An IC tag 201 includes an IC chip mounted on a print board 608. Therefore, by which the print board 608 connects to the socket 607, the IC tag 201 can connect to the IC tag read/write board 606.

The IC tag read/write board 606 is used for recycling a process unit 108 as follows. An IC tag 201 is removed from a used process unit 108, and then the IC tag 201 is mounted on the IC tag read/write board 606. Next, a user operates a computer 601 to write recycling information on the IC tag 201 by the IC tag read/write board 606. After that, the IC tag 201 is removed from the IC tag read/write board 606, and is mounted on a process unit 108 again.

In detail, an IC tag read/write device 602 transmits recycling information to a CPU 203 in an IC chip mounted in an IC tag 201 via an 12C bus 604 and writes recycling information on a memory area in the IC tag 201, and/or reads recycling information for a process unit 108, a working history, a trouble history, parts information, and etc. The recycling information includes parts information, a recycling date, a number of recycling time and etc., which is information on a recycled time of a process unit 108, and a filling amount of a toner, a expiration date, a color ID in the case that a color toner uses, which is information for refilling a toner. In any case, if a process unit 108 has a prohibition code in an IC tag 201 of a process unit 108, an IC tag read/write device 602 can delete the prohibition code in the IC tag 201, and then write recycling information explained above.

In the case that a consumable item is like a process unit 108 with an IC tag socket 621, a connector 605 of an 12C bus 604 in the IC tag read/write board 606 can directly connect to the IC tag socket 621, so that recycling information is read or written.

In another embodiment, a type read/write device 610 can be used. The type read/write device 610 can read or write information by wireless, and connects to a computer 601 via a USB cable 611. However, any standard for connecting with a computer can be used. The type read/write device 610 can also write recycling information on an IC tag 201, operated by a computer 601, and can read recycling information from an EEPROM 209 for recycling a process unit 108. A process for recycling a process unit 108 is almost same with an IC tag read/write device 602 explained above.

In many of the preceding embodiments, specific functions (such as counting pages, measuring time, comparing to limits, initiating code overwrites) are described as being performed in the image forming apparatus. However, in other embodiments, the consumable item may be equipped with a 'smart' tag that performs one or more of the functions previously described as being performed in the image forming apparatus.

The application claims priority to Japanese patent application nos. 2004-078181 and 2004-306707, filed on Mar. 18, 2004 and Oct. 21, 2004, the disclosures of which are incorporated by reference herein in their entirety.

The invention claimed is:

1. An image forming apparatus configured to communicate with a consumable item that includes a memory and a first communication member, comprising:

a positioning member configured to detachably mount said consumable item to said image forming apparatus;

a second communication member configured to communicate to said first communication member;

a recognizing member connected to said second communication member and configured to read a property stored in the memory via said second communication member, and to recognize if the consumable item can be used;

a property changing member connected to said second communication member and to said recognizing member, said property changing member configured to communicate to the memory via said second communication member and to change a parameter stored in said memory, when said recognizing member recognizes the consumable item can no longer be used, so that information stored in the memory cannot be accessed.

2. The apparatus as claimed in claim 1, further comprising:

a used time count member configured to count a used time of the consumable item, wherein said memory is configured to store the used time, said recognizing member is configured to read the used time and a used time limit stored in the memory and to recognize if the used time exceeds the used time limit, and said property changing member is configured to change said parameter when the used time exceeds the used time limit.

3. The apparatus as claimed in claim 2, further comprising:

an image count member configured to count an image forming number of the consumable item, wherein said memory is configured to store the image forming number, said recognizing member is configured to read the image forming number and an image forming limit stored in the memory and to recognize if the image forming number exceeds the image forming limit, and said property changing member is configured to change to said parameter when the image forming number exceeds the image forming limit.

4. The apparatus as claimed in claim 1, further comprising:

an image count member configured to count an image forming number of the consumable item, wherein said memory is configured to store the image forming number, said recognizing member is configured to read the image forming number and an image forming limit stored in the memory and to recognize if the image forming number exceeds the image forming limit, and said property changing member is configured to change said parameter when the image forming number exceeds the image forming limit.

5. The apparatus as claimed in claim 4, further comprising:

a used time count member configured to count a used time of the consumable item, wherein said memory is configured to store the used time, said recognizing member is configured to read the used time and a used time limit stored in the memory and to recognize if the used time exceeds the used time limit, and said property changing member is configured to change said parameter when the used time exceeds the used time limit.

6. The apparatus as claimed in claim 1, wherein said information comprises one of:

information about a seller selling an image forming apparatus;

information about a seller selling a consumable item;

information about a user using an image forming apparatus; and information about a user using a consumable item.

7. The apparatus as claimed in claim 1, wherein said property changing member is further configured to write an prohibition code in the memory.

8. The apparatus as claimed in claim 7, further comprising:

a warning member configured to emit a warning after the prohibition code is written in the memory.

9. The apparatus as claimed in claim 7, further comprising:

a prohibit member configured to prohibit an operation of said image forming apparatus if the prohibition code is written in the memory.

10. The apparatus as claimed in claim 1, wherein the memory comprises one of:

a non-volatile memory;

an EEPROM; and an IC chip.

11. The apparatus as claimed in claim 1, further comprising:

said consumable item.

12. A consumable device configured to be a component of an image forming apparatus, comprising:

a body configured to detachably mount to said image forming apparatus;

a memory mounted on said body;

a recognizing member connected to said memory and configured to read a property stored in the memory and to recognize if the consumable item can be used;

a property changing member connected to said memory and to said recognizing member, said property changing member configured to change a parameter stored in said memory, when said recognizing member recognizes the consumable item can no longer be used, so that information stored in the memory cannot be accessed.

13. The consumable device as claimed in claim 12, further comprising:

a used time count member configured to count a used time of the consumable item, wherein said memory is configured to store the used time, said recognizing member is configured to read the used time and a used time limit stored in the memory and to recognize if the used time exceeds the used time limit, and said property changing member is configured to change said parameter when the used time exceeds the used time limit.

14. The consumable device as claimed in claim 13, further comprising:

an image count member configured to count an image forming number of the consumable item, wherein said memory is configured to store the image forming number, said recognizing member is configured to read the image forming number and an image forming limit stored in the memory and to recognize if the image forming number exceeds the image forming limit, and said property changing member is configured to change to said parameter when the image forming number exceeds the image forming limit.

15. The consumable device as claimed in claim 12, further comprising:

an image count member configured to count an image forming number of the consumable item, wherein said memory is configured to store the image forming number in the memory, said recognizing member is configured to read the image forming number and an image forming limit stored in the memory and to recognize if the image forming number exceeds the image forming limit, and said property changing member is configured to change to parameter when the image forming number exceeds the image forming limit.

16. The consumable device as claimed in claim 15, further comprising:

a used time count member configured to count a used time of the consumable item, wherein said memory is configured to store the used time, said recognizing member is configured to read the used time and a used time limit stored in the memory and to recognize if the used time exceeds the used time limit, and said property changing member is configured to change to said parameter stored in said memory when the used time exceeds the used time limit.

17. The consumable device as claimed in claim 12, wherein said information comprises one of:

information about a seller selling an image forming apparatus information about a seller selling a consumable item;

information about a user using an image forming apparatus; and information about a user using a consumable item.

18. The consumable device as claimed in claim 12, wherein said property changing member is further configured to write a prohibition code in the memory.

19. The consumable device as claimed in claim 18, further comprising:

a warning member configured to emit a warning after the prohibition code is written in the memory.

20. The consumable device as claimed in claim 18, further comprising:

a prohibit member configured to prohibit an operation of said image forming apparatus if the prohibition code is written in the memory.

21. The consumable device as claimed in claim 12, wherein the memory comprises one of:

a non-volatile memory;

an EEPROM; and an IC chip.

22. The consumable device as claimed in claim 12, further comprising one of:

a photoconductive member;

a charging device;

a developing device, and a cleaning device.

23. The consumable device as claimed in claim 12, further comprising:

a fixing device configured to fix an image on a recording medium.

24. The consumable device as claimed in claim 23, further comprising:

a fixing belt mounted in said fixing device;

an oil; and an oil coating unit configured to coat said oil on said fixing belt.

25. The consumable device as claimed in claim 23, further comprising:

a heat insulator configured to surround said memory.

26. The consumable device as claimed in claim 23, further comprising:

a draw connector configured to detachably connect to a connector of an image forming apparatus.

27. A method for managing a consumable item having a memory with information stored therein, said consumable item detachably connected to an image forming apparatus, comprising:

using said consumable item in said image forming apparatus;

preventing access to said information, when the consumable item can no longer be used, by changing a parameter stored in said memory; and writing a prohibition code in the memory to prohibit an operation of said consumable item.

28. The method of claim 27, said step of preventing comprising:

counting a used time of the consumable item; and determining when the used time exceeds a used time limit.

29. The method of claim 28, said step of preventing further comprising:

counting an image forming number of the consumable item; and determining if the image forming number exceeds an image forming limit.

30. The method of claim 29, further comprising:

detecting whether a door of said image forming apparatus is open or closed.

31. The method of claim 27, said step of preventing comprising:

counting an image forming number of the consumable item; and determining if the image forming number exceeds an image forming limit.

32. The method of claim 31, said step of preventing further comprising:

counting a used time of the consumable item; and determining when the used time exceeds a used time limit.

33. The method of claim 27, further comprising:

deleting said prohibit code.

34. The method of claim 27, further comprising:

initializing said consumable item for use.

35. An image forming apparatus, comprising:

means for using a consumable item detachably connected to said image forming apparatus;

means for preventing access to information stored in a memory of the consumable item when the consumable item can no longer be used, said means for preventing access including means for writing a prohibition code in the memory to prohibit an operation of said consumable item.

36. A consumable item configured to be detachably mounted to an image forming apparatus, comprising:

means for storing information in a memory of said consumable item;

means for preventing access to said information when the consumable item can no longer be used, said means for preventing access including means for writing a prohibition code in the memory to prohibit an operation of said consumable item.

* * * * *